US006539185B2

(12) United States Patent
Hanyu et al.

(10) Patent No.: US 6,539,185 B2
(45) Date of Patent: Mar. 25, 2003

(54) FIXING APPARATUS AND IMAGE-FORMING APPARATUS

(75) Inventors: Naohiko Hanyu, Tokyo (JP); Shinsuke Fujita, Tokyo (JP); Yuji Tamura, Tokyo (JP); Tomoya Motoyoshi, Tokyo (JP); Eiji Anzai, Tokyo (JP)

(73) Assignee: Konica Corporation, Tokyo (JP)

( * ) Notice: Subject to any disclaimer, the term of this patent is extended or adjusted under 35 U.S.C. 154(b) by 2 days.

(21) Appl. No.: 09/863,985

(22) Filed: May 23, 2001

(65) Prior Publication Data

US 2001/0048822 A1 Dec. 6, 2001

(30) Foreign Application Priority Data

May 31, 2000 (JP) ..... 2000-162107

(51) Int. Cl.[7] ..... G03G 15/20

(52) U.S. Cl. ..... 399/67; 399/69; 399/21; 219/216

(58) Field of Search ..... 219/216; 399/21, 399/67, 68, 69, 70, 328, 330

(56) References Cited

U.S. PATENT DOCUMENTS 5,561,512 A * 10/1996 Fukano et al. ..... 219/216
6,385,410 B1 * 5/2002 Hanyu et al. ..... 399/68

* cited by examiner

*Primary Examiner*—Hoang Ngo
(74) *Attorney, Agent, or Firm*—Frishauf, Holtz, Goodman & Chick, P.C.

(57) ABSTRACT

The present invention concerns a fixing apparatus and an image-forming apparatus. The fixing apparatus and the image-forming apparatus include a heating roller; a heating element disposed in the heating roller; a pressing roller pressure-contacting the heating roller to fix an image onto a transfer sheet passing through a pressure-contacting section between the heating roller and the pressing roller; and a cooling device to cool the heating roller. In the fixing apparatus, the cooling device is activated during a predetermined time period after consecutive fixing operations are completed. While, the image-forming apparatus further includes a control section to activate the cooling device during a predetermined time period after consecutive fixing operations are completed.

10 Claims, 27 Drawing Sheets

FIG. 10 ( a )
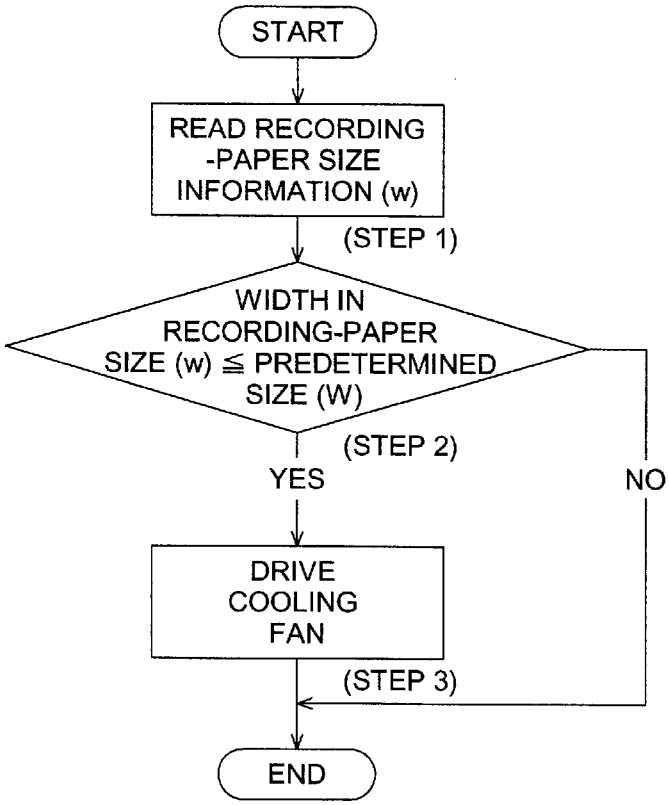
FIG. 10 ( b )
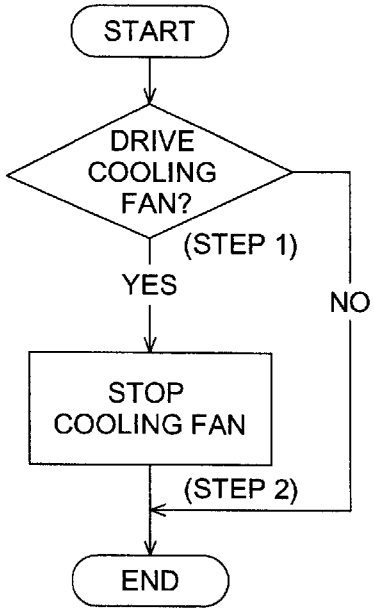

FIXING APPARATUS AND IMAGE-FORMING APPARATUS

BACKGROUND OF THE INVENTION

This invention relates to a fixing apparatus which has a heating roller having a heating means inside and a pressing roller being in pressure contact with said heating roller, and makes a transfer material having a toner image transferred on it pass between the above-described heating roller and pressing roller to thermally fix said toner image to said transfer material.

In conventional fixing apparatus, when the driving operation for the heating roller is stopped at the time of completion of the fixing operation, occurrence of jams, etc., the heating operation for the heating means equipped on the heating roller is also stopped at the same time.

In the abovementioned fixing apparatus, however, a quantity of heat being necessary during driving the heating roller is greater than a quantity of heat being necessary during stopping the heating roller, due to influence of loses of heat dispersing to the pressing roller and into the ambient atmosphere.

Accordingly, in case that the hating means is still driven just before the heating roller is stopped, the heating roller stores an excessive quantity of heat in it after it stops.

There has been a problem that, as shown in FIG. 27, when the heating roller stops in the abovementioned situation, a transient overshoot (to exceed a predetermined temperature) is generated in the temperature characteristic on the surface of the heating roller due to the excessive quantity of heat, resulting in deterioration of the surface layer durability of the heating roller and activation of an extraordinary high-temperature alarm of the fixing apparatus.

In addition, recently, the thickness of the heating roller base body has been made as thinner as possible to reduce its heat capacity in the saving energy point of view.

In this case, as shown in FIG. 28, the thinner the thickness of the heating roller base body, the larger the amount of the overshoot.

SUMMARY OF THE INVENTION

To overcome the abovementioned drawbacks in conventional fixing apparatus, it is an object of the present invention to provide a fixing apparatus, which makes it possible to suppress a temperature overshoot of the heating roller when the heating roller is stopped.

Accordingly, to overcome the cited shortcomings, the abovementioned object of the present invention can be attained by fixing apparatus and image-forming apparatus described as follow.

(1) A fixing apparatus, comprising: a heating roller; a heating element disposed in the heating roller; a pressing roller pressure-contacting the heating roller to fix an image onto a transfer sheet passing through a pressure-contacting section between the heating roller and the pressing roller; and a cooling device to cool the heating roller; wherein the cooling device is activated during a predetermined time period after consecutive fixing operations are completed.

(2) The fixing apparatus of item 1, wherein the consecutive fixing operations correspond to a number of prints included in a JOB designated in advance.

(3) The fixing apparatus of item 1, wherein a cooling region cooled by the cooling device is variable in a longitudinal direction of the heating roller.

(4) A fixing apparatus, comprising: a heating roller; a heating element disposed in the heating roller; a pressing roller pressure-contacting the heating roller to fix an image onto a transfer sheet passing through a pressure-contacting section between the heating roller and the pressing roller; a temperature detecting device to detect a temperature of the heating roller; and a cooling device to cool the heating roller; wherein the cooling device is activated after consecutive fixing operations are completed, so as to lower the temperature of the heating roller to a predetermined temperature based on a result detected by the temperature detecting device.

(5) The fixing apparatus of item 4, wherein the consecutive fixing operations correspond to a number of prints included in a JOB designated in advance.

(6) A fixing apparatus, comprising: a heating roller; a heating element disposed in the heating roller; a pressing roller pressure-contacting the heating roller to fix an image onto a transfer sheet passing through a pressure-contacting section between the heating roller and the pressing roller; and a cooling device to cool the heating roller; wherein, in case of a jam occurrence, the heating element is deactivated and the cooling device is activated until a jam-processing is completed.

(7) The fixing apparatus of item 6, further comprising: a temperature detecting device to detect a temperature of the heating roller; wherein the cooling device is deactivated either when the jam processing is completed or when the temperature of the heating roller is lowered to a predetermined temperature based on a result detected by the temperature detecting device.

(8) The fixing apparatus of item 6, wherein the cooling device is deactivated either when the jam processing is completed or when a predetermined time period has elapsed.

(9) The fixing apparatus of item 6, wherein a cooling region cooled by the cooling device is variable in a longitudinal direction of the heating roller.

(10) An image-forming apparatus, comprising: a heating roller; a heating element disposed in the heating roller; a pressing roller pressure-contacting the heating roller to fix an image onto a transfer sheet passing through a pressure-contacting section between the heating roller and the pressing roller; and a cooling device to cool the heating roller; and a control section to activate the cooling device during a predetermined time period after consecutive fixing operations are completed.

(11) The image-forming apparatus of item 10, wherein a cooling region cooled by the cooling device is variable.

(12) The image-forming apparatus of item 11, wherein the cooling device comprises a plurality of fans arrayed in a longitudinal direction of the heating roller, and the image-forming apparatus further comprising: a cooling region varying device to shade the heating roller from wind blown by several fans included in a plurality of the fans, in order to vary a cooling region cooled by the cooling device.

(13) An image-forming apparatus, comprising: a heating roller; a heating element disposed in the heating roller, a pressing roller pressure-contacting the heating roller to fix an image onto a transfer sheet passing through a pressure-contacting section between the heating roller and the pressing roller; a temperature detecting device to detect a temperature of the heating roller; a cooling device to cool the heating roller; and a control section to activate the cooling device after consecutive fixing operations are completed, so as to lower the temperature of the heating roller to a predetermined temperature based on a result detected by the temperature detecting device.

(14) An image-forming apparatus, comprising: a heating roller; a heating element disposed in the heating roller; a pressing roller pressure-contacting the heating roller to fix an image onto a transfer sheet passing through a pressure-contacting section between the heating roller and the pressing roller; a cooling device to cool the heating roller; a jam-detecting device to detect a jam occurrence; and a control section to deactivate the heating element and to activate the cooling device when the jam-detecting device detects the jam occurrence, until a jam-processing is completed.

(15) The image-forming apparatus of item 14, further comprising: a door member to be opened and closed when the jam-processing is performed; and a door status detecting device to detect an opened or closed status of the door member; wherein the control section deactivates the cooling device and activates again the heating element when the jam-detecting device detects a completion of the jam-processing and the door status detecting device detects the closed status of the door member.

(16) The image-forming apparatus of item 14, further comprising: a temperature detecting device to detect a temperature of the heating roller; wherein the control section deactivates the cooling device either when the jam-processing is completed or when the temperature of the heating roller is lowered to a predetermined temperature based on a result detected by the temperature detecting device.

(17) The image-forming apparatus of item 14, wherein the control section deactivates the cooling device either when the jam-processing is completed or when a predetermined time period has elapsed.

(18) The image-forming apparatus of item 14, wherein a cooling region cooled by the cooling device is variable.

(19) The image-forming apparatus of item 18, wherein the cooling device comprises a plurality of fans arrayed in a longitudinal direction of the heating roller, and the image-forming apparatus further comprising: a cooling region varying device to shade the heating roller from wind blown by several fans included in a plurality of the fans, in order to vary a cooling region cooled by the cooling device.

(20) An image-forming apparatus, comprising: a heating roller; a heating element disposed in the heating roller; a pressing roller pressure-contacting the heating roller to fix an image onto a transfer sheet passing through a pressure-contacting section between the heating roller and the pressing roller; a fixing output detecting device, disposed at a downstream side with respect to the pressure-contacting section in a conveyance direction of the transfer sheet, to detect a passage of the transfer sheet; and a control section to control the heating element; wherein, when the fixing output detecting device detects a passage of a final transfer sheet included in a prescribed job, the control section switches a threshold value for controlling a fixing temperature to a lower value than that during a fixing operation, before deactivating a rotation of the heating roller.

(21) An image-forming apparatus, comprising: a heating roller; a heating element disposed in the heating roller; a pressing roller pressure-contacting the heating roller to fix an image onto a transfer sheet passing through a pressure-contacting section between the heating roller and the pressing roller; a temperature detecting device to detect a temperature of the heating roller; a fixing output detecting device, disposed at a downstream side with respect to the pressure-contacting section in a conveyance direction of the transfer sheet, to detect a passage of the transfer sheet; and a control section to control the heating element; wherein, when the fixing output detecting device detects a passage of a final transfer sheet included in a prescribed job, the control section deactivates the heating element before deactivating a rotation of the heating roller and continues deactivating the heating element until the rotation of the heating roller is deactivated.

Further, to overcome the abovementioned problems, other fixing apparatus, embodied in the present invention, will be described as follow:

(22) A fixing apparatus, characterized in that, in the fixing apparatus, which comprises a heating roller having a heating means, serving as a heating element, in it and a pressing roller pressure-contacting the heating roller to fix a toner image, transferred on a transfer sheet, with heat onto the transfer sheet by passing the transfer sheet between the heating roller and the pressing roller, a cooling means, serving as a cooling device, for cooling the heating roller and a control section for activating the cooling means during a predetermined time period after the fixing operation is completed are provided.

Since the control section continues to activate the cooling means during a predetermined time period after the fixing operation is completed, the temperature overshoot of the heating roller can be suppressed when the heating roller stops.

Incidentally, the abovementioned passage of "after the fixing operation is completed" is equivalent to a passage of "after consecutive fixing operations are completed", or equivalent to a passage of "after fixing operations necessary for a designated job are completed". Further, although the control section can determine the completion of the fixing operation, for instance, based on a result, detected by a sensor equipped in the fixing apparatus, that all transfer sheets required for one designated job has passed, it is also possible to determine the completion of the fixing operation based on a result that a motor for driving the rotation of rollers of the fixing apparatus stops.

(23) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a temperature detecting means, serving as a temperature detecting device, for detecting a temperature of the heating roller, a cooling means for cooling the heating roller, and a control section for activating the cooling means until the temperature of the heating roller reaches to a predetermined temperature after the fixing operation is completed by receiving temperature information from the temperature detecting means, are provided.

Since the control section continues to activate the cooling means until the temperature of the heating roller reaches to a predetermined temperature after the fixing operation is completed by receiving the temperature information from the temperature detecting means, the temperature overshoot of the heating roller can be suppressed when the heating roller stops.

(24) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a cooling means for cooling the heating roller, and a control section for deactivating the heating means of the heating roller at the time of the jam-occurrence by receiving jam-information and continuing to activate the cooling means until the jam processing is completed, are provided.

Since the control section deactivates the heating means of the heating roller at the time of the jam-occurrence and continues to activate the cooling means until the jam processing is completed, the temperature overshoot of the heating roller can be suppressed when the heating roller stops.

Incidentally, the jam-processing is regarded as being completed when the jam-detecting device detects a completion of the jam-processing and the door status detecting device detects the closed status of the door member to be opened and closed when the jam-processing is performed.

(25) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a temperature detecting means for detecting a temperature of the heating roller, a cooling means for cooling the heating roller, and a control section for deactivating the heating means of the heating roller at the time of the jam-occurrence by receiving the jam-information and continuing to activate the cooling means either until the temperature of the heating roller reaches to the predetermined temperature or until the jam processing is completed by receiving temperature-information from the temperature detecting means, are provided.

Since the control section deactivates the heating means of the heating roller at the time of the jam-occurrence and continues to activate the cooling means either until the temperature of the heating roller reaches to the predetermined temperature or until the jam processing is completed, the temperature overshoot of the heating roller can be suppressed when the heating roller stops.

Incidentally, it is possible to prevent the temperature of the heating roller from excessively decreasing lower than a necessary temperature level and to minimize the influence exerted to the fixing operations to be performed since then by deactivating the cooling means either when the temperature of the heating roller reaches to the predetermined temperature or when the jam-processing is completed after the jam occurrence. Further, it is also possible to obtain the same effect as that mentioned above by deactivating the cooling means either when a predetermined time period has elapsed or when the jam-processing is completed after the jam occurrence.

(26) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a cooling means for cooling the heating roller, and a control section for deactivating the heating means of the heating roller at the time of the jam-occurrence by receiving the jam-information and continuing to activate the cooling means either during the predetermined time period or until the jam -processing is completed, are provided.

Since the control section deactivates the heating means of the heating roller at the time of the jam-occurrence and continues to activate the cooling means the temperature overshoot of the heating roller can be suppressed when the heating roller stops.

(27) The fixing apparatus cited in any one of items 22–26, characterized in that the cooling region of the cooling means is variable in the longitudinal direction of the heating roller.

Since the cooling region of the cooling means is variable in the longitudinal direction of the heating roller, it becomes possible to cool all over the heating roller to suppress its temperature overshoot when the heating roller stops.

Further, when the fixing operation repeatedly conducted for fixing a large number of transfer sheets having a narrow width, it is also possible to cool only the end portion of the heating roller to prevent the end portion of the heating roller from over heating.

(28) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a temperature detecting means for detecting a temperature of the heating roller, a fixing-output detecting means, serving as a fixing-output detecting device, disposed at the outlet for detecting a passage of the transfer sheet, and a control section for deactivating the heating means of the heating roller when the final recording-paper has passed and setting the threshold value of the fixing control temperature at a value lower than the temperature during the fixing operation, are provided.

Since the control section receives the information from the fixing-output detecting means and deactivates the heating means of the heating roller when the final recording-paper has passed, namely, before outputting the instruction for stopping the heating roller, and sets the threshold value of the fixing control temperature at a value lower than the temperature during the fixing operation, the temperature overshoot of the heating roller can be suppressed when the heating roller stops.

In short, the action for driving the heating means is stopped by switching the threshold value of the fixing control temperature to a lower value.

(29) A fixing apparatus, characterized in that, in the fixing apparatus, which comprises a heating roller having a heating means in it and a pressing roller pressure-contacting the heating roller to fix a toner image, transferred on a transfer sheet, with heat onto the transfer sheet by passing the transfer sheet between the heating roller and the pressing roller, a temperature detecting means for detecting a temperature of the heating roller, a fixing-output detecting means disposed at the outlet for detecting a passage of the transfer sheet, and a control section for deactivating the heating means of the heating roller when the final recording-paper has passed by receiving information from the fixing-output detecting means, are provided.

Since the control section deactivates the heating means of the heating roller when the final recording-paper has passed by receiving information from the fixing-output detecting means, namely, during the period from the time before the heating roller stops to the time when the heating roller stops, the temperature overshoot of the heating roller can be suppressed when the heating roller stops.

BRIEF DESCRIPTION OF THE DRAWINGS

Other objects and advantages of the present invention will become apparent upon reading the following detailed description and upon reference to the drawings in which:

FIG. 10(*a*) and FIG. 10(*b*) show flowcharts for explaining fixing control-operations of the fixing apparatus shown in FIG. 3;

DETAILED DESCRIPTION OF THE PREFERRED EMBODIMENT

[First Embodiment]

(Overall Structure)

Figure 1:
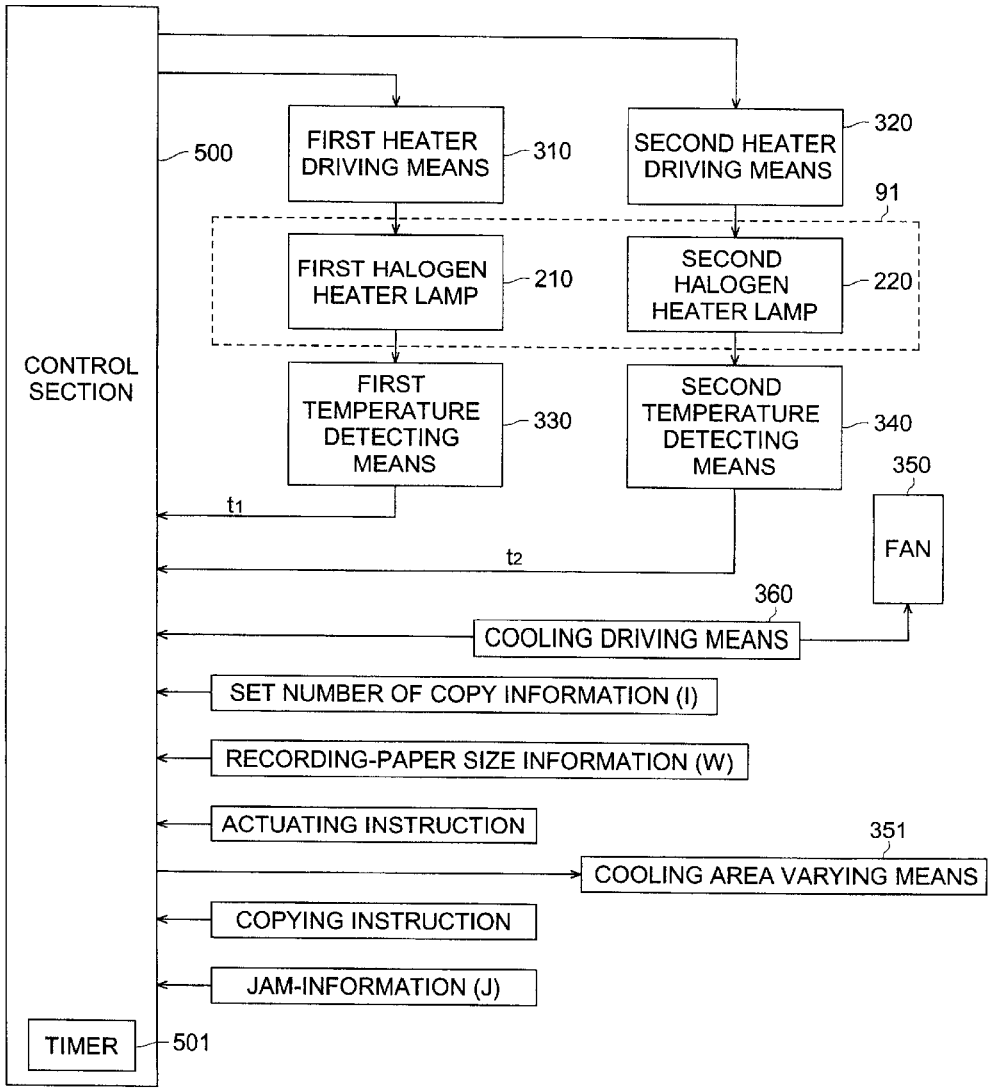
FIG. 1 shows a block diagram for illustrating the electrical structure of the fixing apparatus.

First, with reference to FIG. 2, the overall structure of an image forming apparatus provided with a fixing apparatus of the first embodiment of the invention will be detailed in the following.

In the drawing, the image forming apparatus 1 comprises the automatic document feeder (what is called an ADF) A, the original image reading unit B for reading an image of an original conveyed by the automatic document feeder A, the image control section C for processing the read original image, writing section D including the writing unit 12 for carrying out writing on the image carrying member 10 made up of a photoreceptor drum, the image forming section E including the image carrying member 10 and the image forming means disposed around it such as the charging electrode 14, the developing means 16 composed of a developing apparatus of the magnetic brush type, the charging electrode 18, the detaching electrode 20, and the cleaning means 21, the receiving section F for the plural paper receiving means (hereinafter referred to as a paper feeding tray or a tray) 22 and 24 such as a tray for receiving the transfer material (hereinafter referred to as the recording paper) P, and so forth.

The automatic document feeder A comprises as main components the document stacking base 26 and the document convey-processing unit 28 including a group of rollers including the roller R1 and a switching means for suitably switching the moving path of a document sheet.

The original image reading unit B is composed of the two mirror units 30 and 31 which are disposed under the document glass plate G and capable of moving back and forth with the optical length kept the same, the fixed image forming lens (hereinafter referred to as the lens) 33, the line-shaped image sensor (hereinafter referred to as the CCD) 35, etc., and the writing section D is composed of the laser light source 40, the polygonal mirror (deflector) 42, etc.

With respect to the automatic document feeder A, the principle itself is publicly known although it is different from the conventional automatic document feeders in the structure; further, the original image reading unit B. the writing section D, the image forming apparatus provided with the image processing means (means for forming a toner image on the image carrying member 10 and transferring the toner image onto a sheet), and the image forming process are well known; therefore, explanation of them will be done simply.

Besides, R10, which is shown at the upstream side of the transfer electrode 19, is the registration roller, and H, which is shown at the downstream side of the detaching electrode, is the fixing apparatus (to be described in detail) and is provided with the heating roller 91 and the pressing roller 92 being in pressure contact with the heating roller 91; by making a sheet of the recording paper P having a toner image transferred on it pass through the pressing roller 92 and the heating roller 91, the toner image is thermally fixed on the sheet of the recording paper P.

In the above-described structure, the process, in which a toner image is formed on the image carrying member 10, and the image is transferred onto a sheet, after that, the sheet is ejected onto an output tray, is as follows:

In addition, in this specification, in some cases, the transfer area provided with the transfer electrode is called the image recording section.

A sheet of the document (not shown in the drawing) stacked on the document stacking base 26 is conveyed in the document convey-processing unit 28, and while it passes under the roller R1, a slit exposure by the exposure means L is carried out.

The reflected light from the document passes through the mirror units 30 and 31 disposed at fixed positions and the lens 33, is focused on the CCD, and is read.

The image information read by the original image reading unit B is processed by the image processing means and coded, to be stored in a memory provided on the image control board C.

The image data is read out in response to image forming, and the laser light source in the writing section D is driven in accordance with said image data, to make exposure to the image carrying member 10.

Preceding this exposure, the image carrying member 10, which is rotating in the direction of the arrow mark (counter clockwise direction) and has been charged to a predetermined electric surface potential by the corona discharge of the charging electrode 14, has its surface potential at the exposed portions reduced in accordance with the exposure amount; as the result, a latent electrostatic image corresponding to the image data is formed on the image carrying member 10.

The latent electrostatic image is reverse-developed by the developing means 16, to make a visible image (toner image).

On the other hand, before the leading edge portion of the toner image on the image carrying member 10 reaches the transfer area, a sheet of the recording paper P in the paper feeding tray 22, for example, is fed and conveyed to reach the registration roller R10, where its leading edge is adjusted.

The sheet P is conveyed to the transfer area in order that it may be superposed on the toner image, that is, the image area on the image carrying member 10, by the registration roller R10 which starts rotating in synchronism with the toner image.

In the transfer area, the toner image on the image carrying member 10 is transferred onto the sheet P by actuating the transfer electrode, and next, the sheet P is detached from the image carrying member 10 by actuating the detaching electrode 20.

After that, by the heating and pressing of the fixing apparatus H, the toner particles forming the toner image are fused and fixed on the sheet P, which is then ejected onto the output tray T through the paper ejection path 78 and the paper ejecting roller 79.

(Fixing Apparatus)

Figure 3:
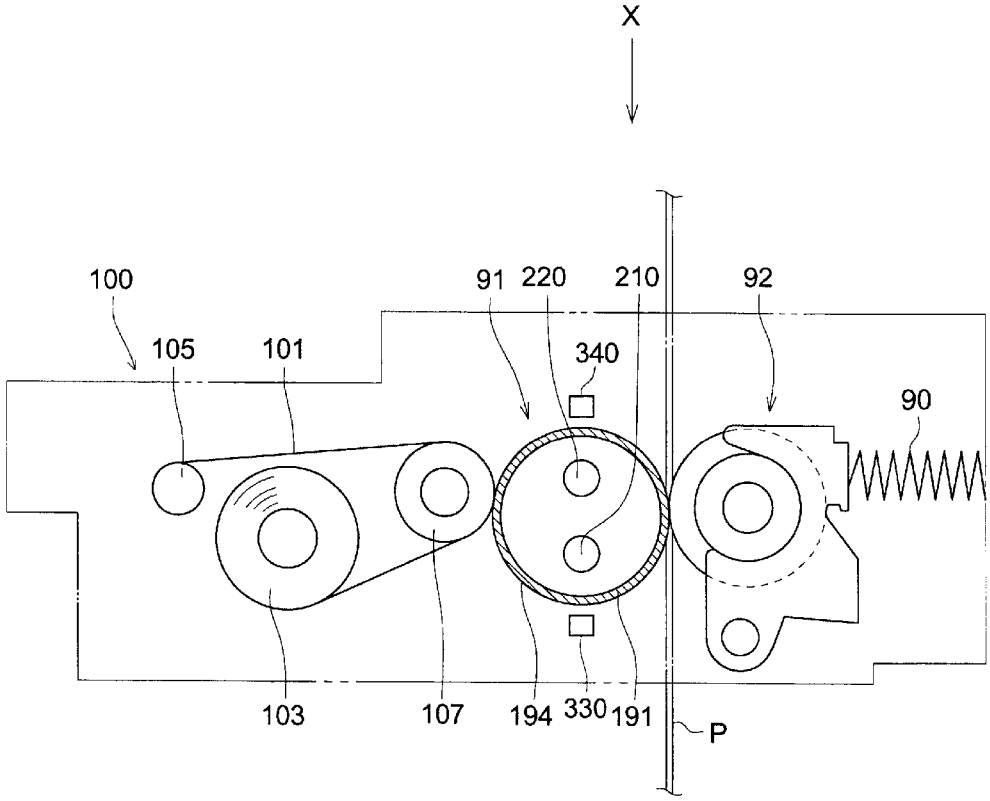
FIG. 3 shows a side view of a fixing apparatus.
Figure 4:
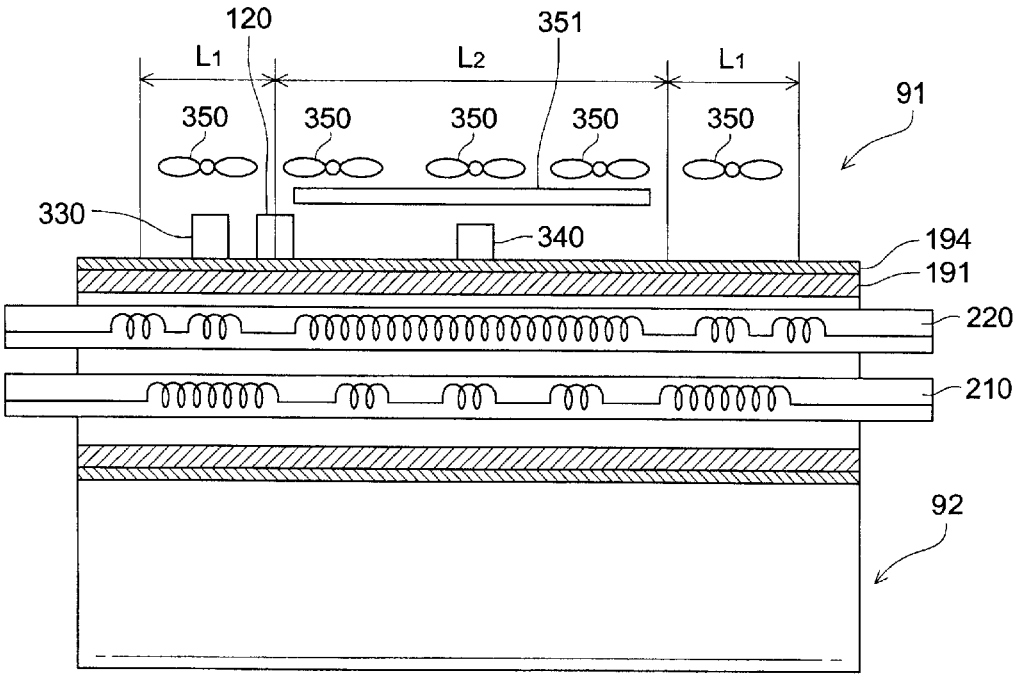
FIG. 4 shows a cross-sectional view along the direction of the arrow mark X in FIG. 3.

The structure of the fixing apparatus H will be explained in detail with reference to FIG. 3 and FIG. 4. FIG. 3 is a side view of the fixing apparatus H, and FIG. 4 is the cross-sectional view along the direction of the arrow mark X in FIG. 3.

In the heating roller 91, 191 denotes the cylindrical sleeve (roller base member) with the both side ends opened.

On the outer circumferential surface of this sleeve 191, the releasing layer 194 is formed.

In this example of the embodiment of the invention, the material of the sleeve 191 is either aluminum or iron, and the material of the releasing layer 194 is a resin such as a PFA (copolymer of tetrafluoro-ethylene/perfluoro-alkylvinyl ether) or a tetrafluoro-ethylene.

Further, the thickness of the sleeve 191 is equal to or smaller than 2.0 mm, and the film thickness of the releasing layer is approximately 20 $\mu$m.

Inside the heating roller 91, there are provided the first halogen heater lamp 210 as the first heating means for mainly heating the area (L1) which is inside the area which a sheet of recording paper P of the usable maximum size passes and is outside the area which a sheet of recording paper P of the predetermined size (for instance, B5R size) passes, and the second halogen heater lamp 220 as the second heating means for mainly heating the area (L2) which a sheet of recording paper P of the predetermined size passes.

The pressing roller 92 has a structure having a PFA tube covering the circumferential surface of the foaming silicone rubber, and its surface hardness is in a range of 35–75° (Asker C hardness).

Further, the pressing roller 92 presses the heating roller 91 with a total load 5–25 kgf by the urging force of the spring 90, to make the nip pressure between the pressing roller 92 and the heating roller 91 0.2–2.0 kgf/cm$^2$, and the nip passing time is 20–40 msec.

Figure 2:
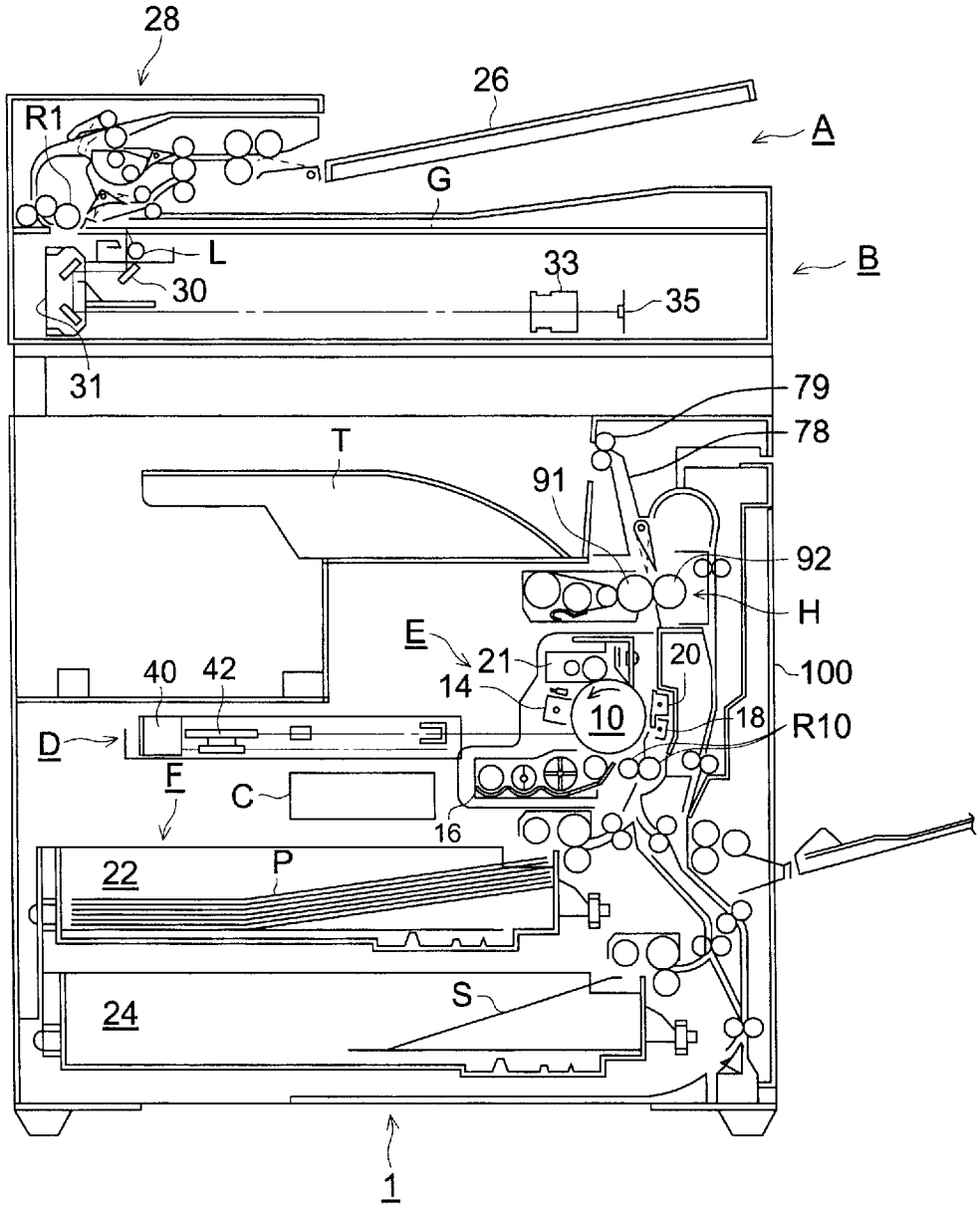
FIG. 2 shows an overall structure of an image forming apparatus provided with a fixing apparatus of the first embodiment of the present invention.

In the fixing apparatus H of this example of the embodiment of the invention, as shown in FIG. 2, two temperature detecting means 330 and 340 are provided. One is the first temperature detecting means 330 for detecting the temperature of the area L1 of the heating roller 91, and the other is the second temperature detecting means 340 for detecting the temperature of the area L2 of the heating roller 91. In addition, in this example of the embodiment, a thermister is used for the temperature detecting means.

Further, in the neighborhood of the border of the first halogen heater lamp 210 and the second halogen heater lamp 220 of the heating roller 91, the thermostat 120 is provided. Numeral 350 denotes a plurality of fans for cooling over all area (including area L1 and area L2) in the axial direction of the heating roller 91.

Still further, numeral 351 denotes cooling area varying means, which is disposed at the area L2 and movable in the circumferential direction of the heating roller 91. The cooling area varying means 351 approaches to the vicinity of the fan 350 to prevents the area L2 from being blown by the wind of the fan 350, and leaves from the vicinity of the fan 350 to allow the area L2 to be blown by the wind of the fan 350.

The cleaning mechanism 100 is composed of the supplying roller 103 having the web 101 made of nonwoven fabric of an aromatic polyamide wound on it, the take-up roller 105 for winding up the web 101, and the backup roller 107 for pressing the web to the heating roller 91.

This take-up roller 105 is driven to rotate by a predetermined amount after image formation is made on a predetermined number of sheets of the recording paper P, and the unused portion of the web 101 is pressed to the heating roller 91.

In the following, with reference to FIG. 1, the electrical structure of the fixing apparatus of this example of the embodiment will be explained. FIG. 1 is a block diagram for illustrating the electrical structure of the fixing apparatus shown in FIG. 3.

In the drawing, 310 denotes the first heater driving means composed of a circuit driving the first halogen heater lamp 210, and 320 denotes the second heater driving means composed of a circuit driving the second halogen heater lamp 220.

500 denotes the control section, and drives the first and second halogen heater lamps 210 and 220 through the first and second heater driving means 310 and 320, and also drives the fan 350 and the cooling area varying means 351 through the cooling driving means 360, by receiving the temperature information (t1) from the first temperature detecting means 330, the temperature information (t2) from the second temperature detecting means 340, the actuating instruction transmitted from the image forming apparatus mainframe when the power switch of the image forming apparatus mainframe is turned on, the copying instruction transmitted from the image forming apparatus mainframe when the copy button of the image forming apparatus mainframe is turned on, the recording paper size information (W), the set copy number information (I) and the jam information (J) sent from the jam detecting means, which are disposed at various places in the image-forming apparatus to detect a jamming of recording paper P.

In addition, the control section 500 comprises a timer 501.

In the following, the operation of the fixing apparatus having the above-described structure will be explained with reference to FIG. 5–FIG. 16.

First, with reference to FIG. 5 which is a flowchart of the overall operation of the control section 500, the overall operation of the fixing apparatus will be explained.

When the power switch is turned on, the warm-up control-operation (step 1) is carried out, and when the warm-up is finished, the fixing apparatus enters into a standby state while performing idling control-operation (step 2), until the next copy command is recieved.

If a copying instruction is given during the idling operation (step 3), the fixing control-operation is carried out (step 4).

If a jam occurs during the fixing control-operation (step 5), the jamming control-operation is carried out until the jam processing is completed (step 6). In addition, if a copy-finishing instruction is given (step 7), the copy-finishing control-operation (step 8) is carried out and the operation returns to the idling operation (step 2).

In the following, the warm-up control-operation, the idling control-operation, the fixing control-operation, the jamming control-operation and the copy-finishing control-operation will be explained.

(Warm-Up Control-Operation)

Explanation will be given with reference to FIG. 6(*a*) and FIG. 6(*b*) and FIG. 7, which are the flow charts for explaining the warm-up control-operation of the fixing apparatus shown in FIG. 3.

Figure 6:
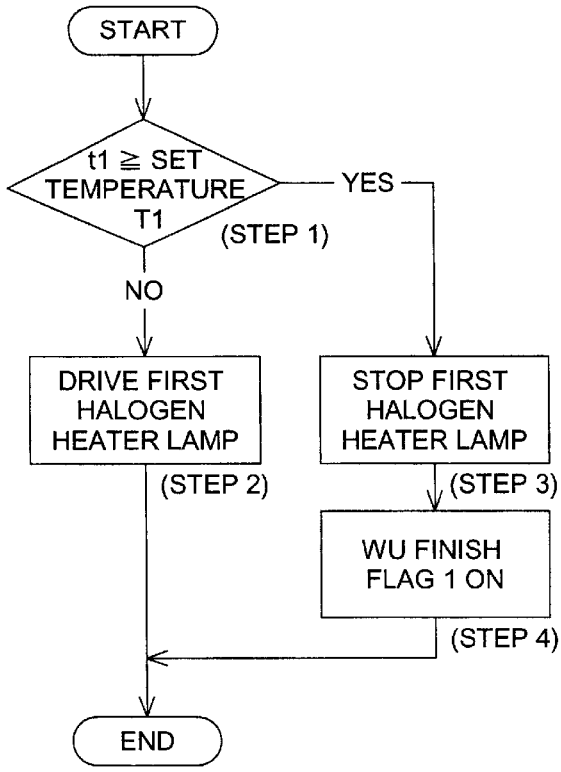
FIG. 6(*a*) and FIG. 6(*b*) show flowcharts for explaining warm-up operations of the fixing apparatus shown in FIG. 3.
Figure 6:
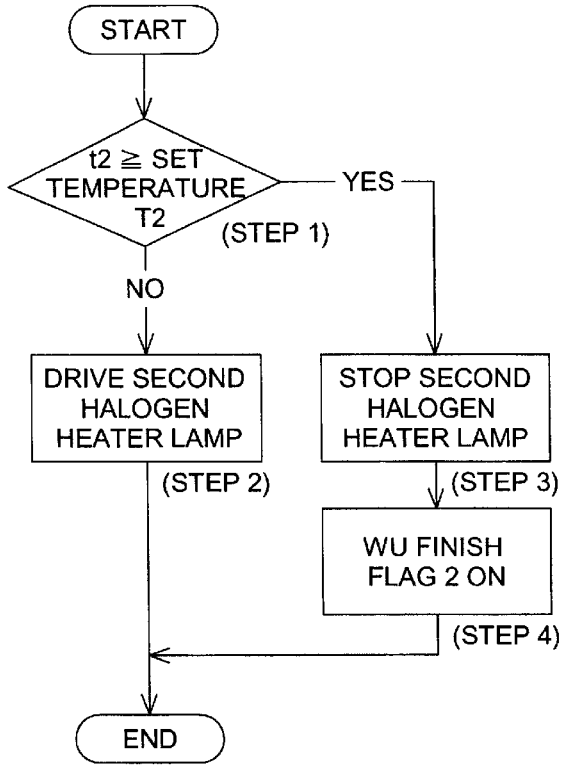

FIG. 6(*a*) shows the flow chart showing the warm-up control-operation of the first halogen heater lamp, FIG. 6(*b*) shows the flow chart showing the warm-up control-operation of the second halogen heater lamp; FIG. 7 is the flow chart showing the finish judging operation for the warm-up control-operation.

Figure 7:
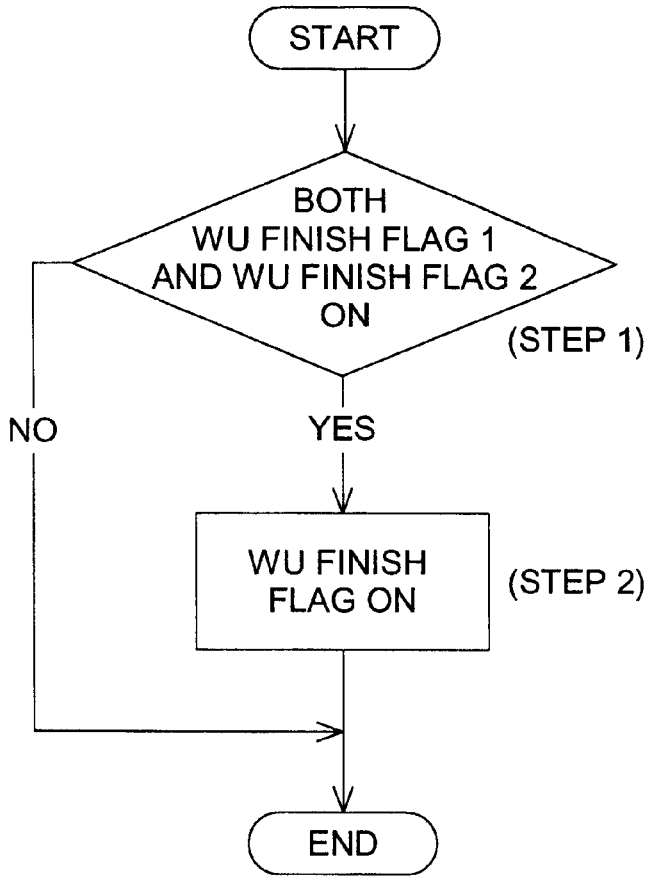
FIG. 7 shows a flowchart for explaining a warm-up operation of the fixing apparatus shown in FIG. 3.

The control section 500 carries out as the warm-up operation three flows, shown in FIG. 6(*a*), FIG. 6(*b*), and FIG. 7, every 200 msec.

In the flow shown in FIG. 6(*a*), it receives the temperature information (t1) from the first temperature detecting means 330, and makes a comparison between the temperature (t1) of the area L1 of the heating roller and the predetermined temperature (T1) (step 1).

If the temperature (t1) of the heating roller 91 is lower than the predetermined temperature (T1), the first halogen heater lamp 210 is driven (step 2).

If the temperature (t1) of the heating roller 91 is equal to or higher than the predetermined temperature (T1), the driving of the first halogen heater lamp 210 is stopped (step 3), and the warm-up (WU) finish flag 1 is turned on (step 4).

Figure 5:
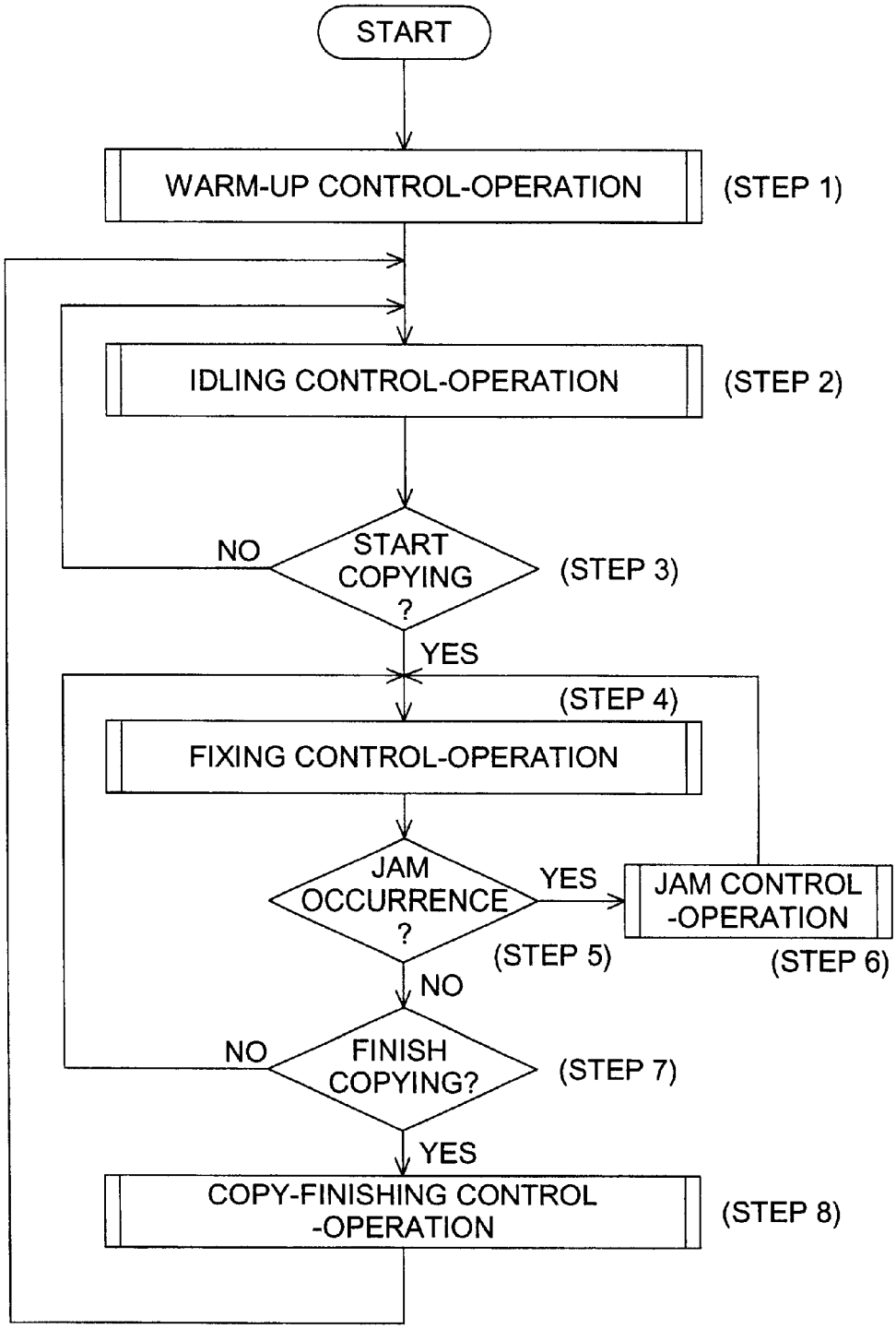
FIG. 5 shows a flowchart for explaining an overall operation of the control section.

In the same manner, in the routine shown in FIG. 5(*b*), the control section receives the temperature information (t2) from the second temperature detecting means 340, and makes a comparison between the temperature (t2) of the area L2 of the heating roller and the predetermined temperature (T2) (step 1).

If the temperature (t2) of the heating roller 91 is lower than the predetermined temperature (T2), the second halogen heater lamp 220 is driven (step 2).

If the temperature (t2) of the heating roller 91 is equal to or higher than the predetermined temperature (T2), the driving of the second halogen heater lamp 220 is stopped (step 3), and the warm-up (WU) finish flag 2 is turned on (step 4).

In the flow shown in FIG. 7, it is watched whether both of the WU finish flag 1 and the WU finish flag 2 are on or not (step 1), and if both are on, the WU finish flag is turned on (step 2).

(Idling Control-Operation)

Explanation will be given with reference to FIG. 8(*a*) and FIG. 8(*b*), which are the flowcharts for explaining the idling operations of the fixing apparatus shown in FIG. 3.

Figure 8:
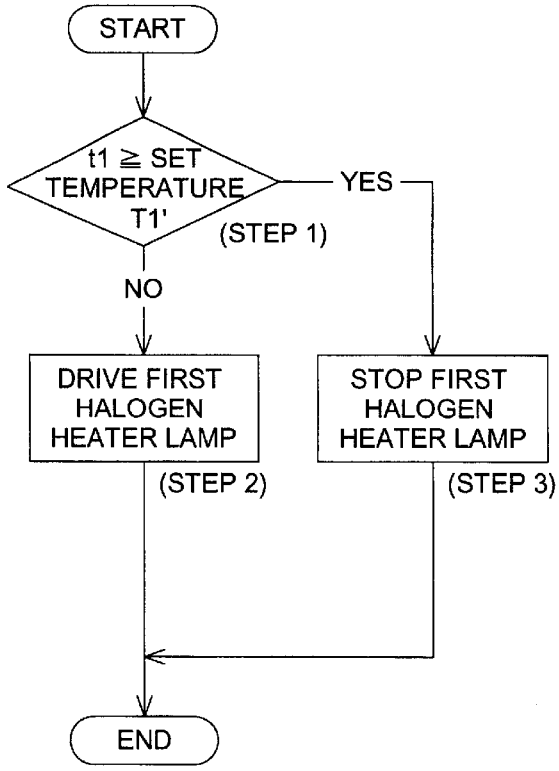
FIG. 8(*a*) and FIG. 8(*b*) show flowcharts for explaining idling operations of the fixing apparatus shown in FIG. 3.
Figure 8:
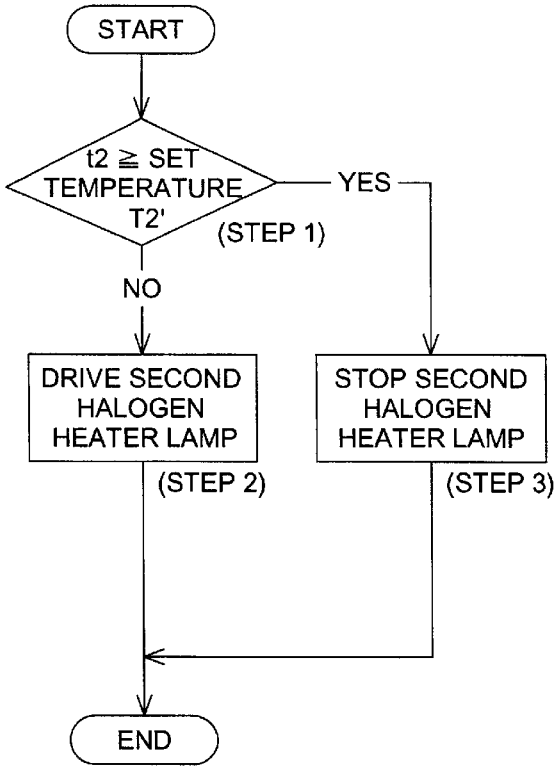

FIG. 8(*a*) shows the flow chart showing the idling operation of the first halogen heater lamp, FIG. 8(*b*) shows the flow chart showing the idling operation of the second halogen heater lamp.

The control section 500 carries out as the idling operation two flows shown in FIG. 8(*a*) and FIG. 8(*b*) every 200 msec.

In the flow shown in FIG. 8(*a*), it receives the temperature information (t1) from the first temperature detecting means 330, and makes a comparison between the temperature (t1) of the area L1 of the heating roller and the predetermined temperature (T1') (step 1).

If the temperature (t1) of the heating roller 91 is lower than the predetermined temperature (T1'), the first halogen heater lamp 210 is driven (step 2).

If the temperature (t1) of the heating roller 91 is equal to or higher than the predetermined temperature (T1'), the driving of the first halogen heater lamp 210 is stopped (step 3).

In the same manner, in the flow shown in FIG. 8(*b*), the control section receives the temperature information (t2) from the second temperature detecting means 340, and makes a comparison between the temperature (t2) of the area L2 of the heating roller and the predetermined temperature (T2') (step 1).

If the temperature (t2) of the heating roller 91 is lower than the predetermined temperature (T2'), the second halogen heater lamp 220 is driven (step 2).

If the temperature (t2) of the heating roller 91 is equal to or higher than the predetermined temperature (T2"), the driving of the second halogen heater lamp 220 is stopped (step 3).

(Copying Control-Operation)

Explanation will be given with reference to FIG. 9(*a*) and FIG. 9(*b*) and FIG. 10(*a*) and FIG. 10(*b*), which are the flow charts for explaining the fixing control-operations of the fixing apparatus shown in FIG. 3.

Figure 9:
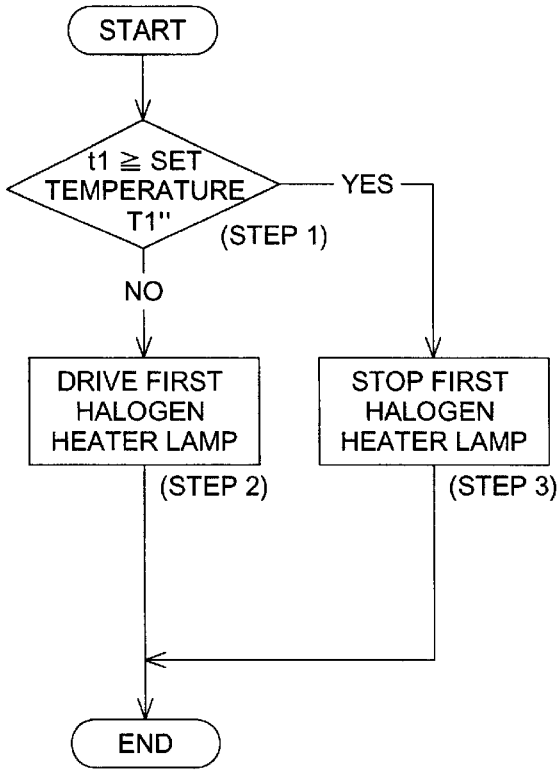
FIG. 9(*a*) and FIG. 9(*b*) show flowcharts for explaining fixing control-operations of the fixing apparatus shown in FIG. 3.
Figure 9:
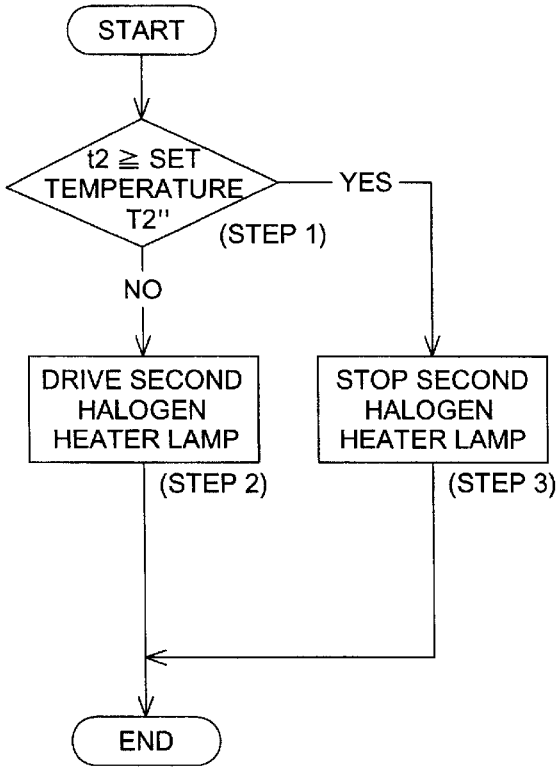

FIG. 9(*a*) is the flow chart showing the copying operation of the first halogen heater lamp, and FIG. 9(*b*) is the flow chart showing the copying operation of the second halogen heater lamp. Further, FIG. 10(*a*) is the flow chart showing the driving operation of the cooling fan, and FIG. 10(*b*) is the flow chart showing the stopping operation of the cooling fan.

The control section 500 carries out as the copying control-operation two flows shown in FIG. 10(*a*) and FIG. 10(*b*) every 200 msec.

In the flow shown in FIG. 9(*a*), it receives the temperature information (t1) from the first temperature detecting means 330, and makes a comparison between the temperature (t1) of the area L1 of the heating roller and the predetermined temperature (T1") (step 1).

If the temperature (t1) of the heating roller 91 is lower than the predetermined temperature (T1"), the first halogen heater lamp 210 is driven (step 2).

If the temperature (t1) of the heating roller 91 is equal to or higher than the predetermined temperature (T1"), the driving of the first halogen heater lamp 210 is stopped (step 3).

In the same manner, in the flow shown in FIG. 9(*b*), the control section receives the temperature information (t2) from the second temperature detecting means 340, and makes a comparison between the temperature (t2) of the area L2 of the heating roller and the predetermined temperature (T2") (step 1).

If the temperature (t2) of the heating roller 91 is lower than the predetermined temperature (T2"), the second halogen heater lamp 220 is driven (step 2).

If the temperature (t2) of the heating roller 91 is equal to or higher than the predetermined temperature (T2"), the driving of the second halogen heater lamp 220 is stopped (step 3).

Further, when a copying instruction is given, the control section carries out once the flow shown in FIG. 10(*a*).

In the flow shown in FIG. 9(*a*), when a copying instruction is given, the control section 500 reads the size information (w) of the recording paper P to be fed (step 1), and compares it with the predetermined size (W: for instance, B5R) (step 2); if the size (w) of the recording paper P to be fed is equal to or smaller than the predetermined size (W), the control section 500 drives the cooling area varying means 351 to such a position where the wind from the fan 350 is prevented to blow the area L2, and then, drives the fan 350 (step 3).

In other wards, the temperature level necessary for the fixing operation is maintained at the area L2 of the heating roller 91, while it is prevented to generate a hot-offset at the end portion of the recording sheet due to the temperature overshoot occurring at the both ends and caused by an excessive temperature increase at the area L1 being outside area of the recording sheet path. However, provided that the driving operation of each of five fans 350 can be controlled independently, it is also possible to suppress the temperature overshoot at the both ends without employing the cooling area varying means 351.

(Jam Control-Operation)

Explanation will be given with reference to FIGS. 11–14, which are the flow charts for explaining the jam control-operation of the fixing apparatus shown in FIG. 3.

Figure 11:
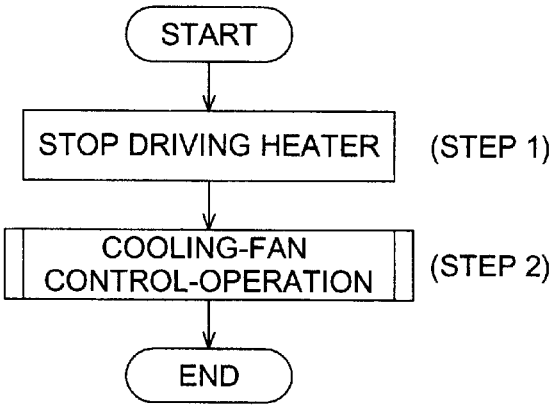
FIG. 11 shows a flowchart of the jam control-operation.
Figure 12:
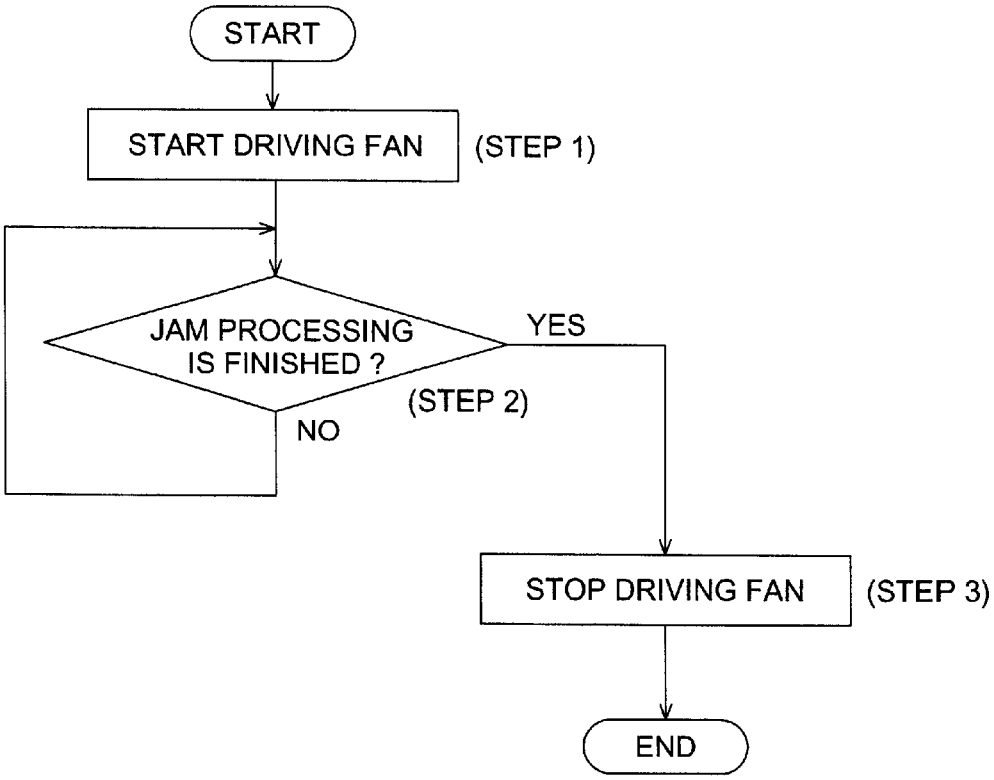
FIG. 12 shows a flowchart of the cooling-fan control-operation shown in FIG. 11.
Figure 13:
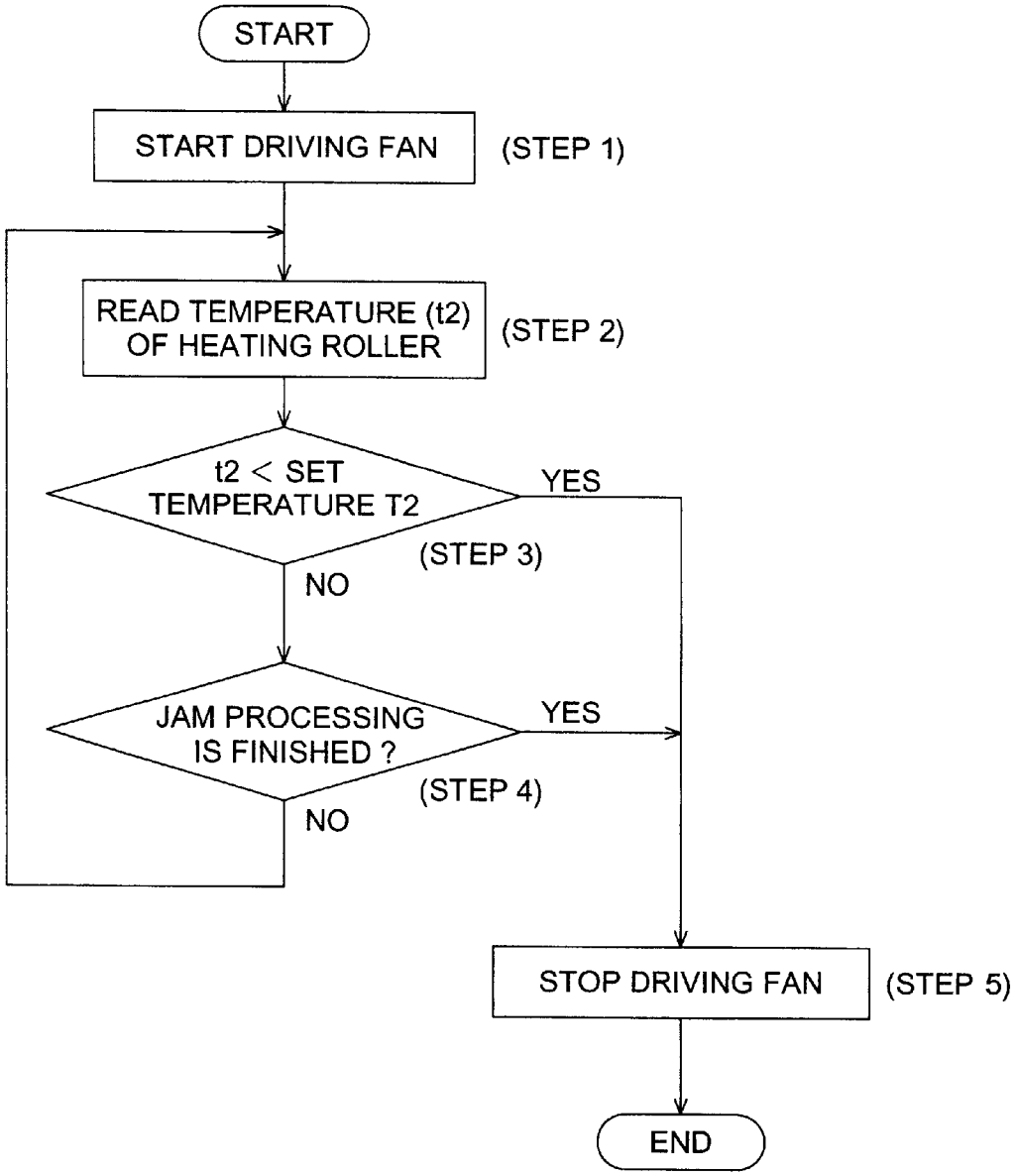
FIG. 13 shows a flowchart of another embodiment of the cooling-fan control-operation shown in FIG. 11.

FIG. 11 shows a flowchart of the jam control-operation, FIG. 12 shows a flowchart of the cooling-fan control-operation shown in FIG. 11, and FIG. 13 shows a flowchart of another embodiment of the cooling-fan control-operation shown in FIG. 11.

When a jam occurs during the fixing control-operation, the control section 500 enters into the jam control-operation mode as shown in FIG. 11.

In FIG. 11, when the control section 500 receives the jam information (J), the control section 500 deactivates the driving operation of the first halogen heater lamp 210 and the second halogen heater lamp 220 (step 1), and conducts the cooling-fan control-operation (step 2).

In the cooling-fan control-operation, the control section 500 activates the fan 350 as shown in FIG. 12. At this time, it is also possible for the control section 500 to move the cooling area varying means 351 to such a position where the wind from the fan 350 is allowed to blow the all area of the heating roller 91, being apart from the fan 350.

When the jam processing is completed (step 2), control section 500 deactivates the fan 350 to finish the jam control-operation and to continue the fixing control-operation. Incidentally, the scope of the cooling-fan control-operation is not limited to the flowchart shown in FIG. 12.

The flowchart shown in FIG. 13 is also applicable.

In FIG. 13, the control section 500 activates the fan 350 (step 1). At this time, the control section 500 moves the cooling area varying means 351 to such a position where the wind from the fan 350 is allowed to blow the all area of the heating roller 91, being apart from the fan 350.

Next, it receives the temperature information (t2) from the second temperature detecting means 340 (step 2), and makes a comparison between the temperature (t2) of the area L2 of the heating roller 91 and the predetermined temperature (T2) (step 3).

The fan 350 is activated until the temperature (t2) of the area L2 of the heating roller 91 decreases lower than the predetermined temperature (T2). When the temperature (t2) of the area L2 of the heating roller 91 decreases lower than the predetermined temperature (T2) or the jam processing is completed (step 4), control section 500 deactivates the fan 350 (step 5) to finish the jam control-operation and to continue the fixing control-operation.

Figure 14:
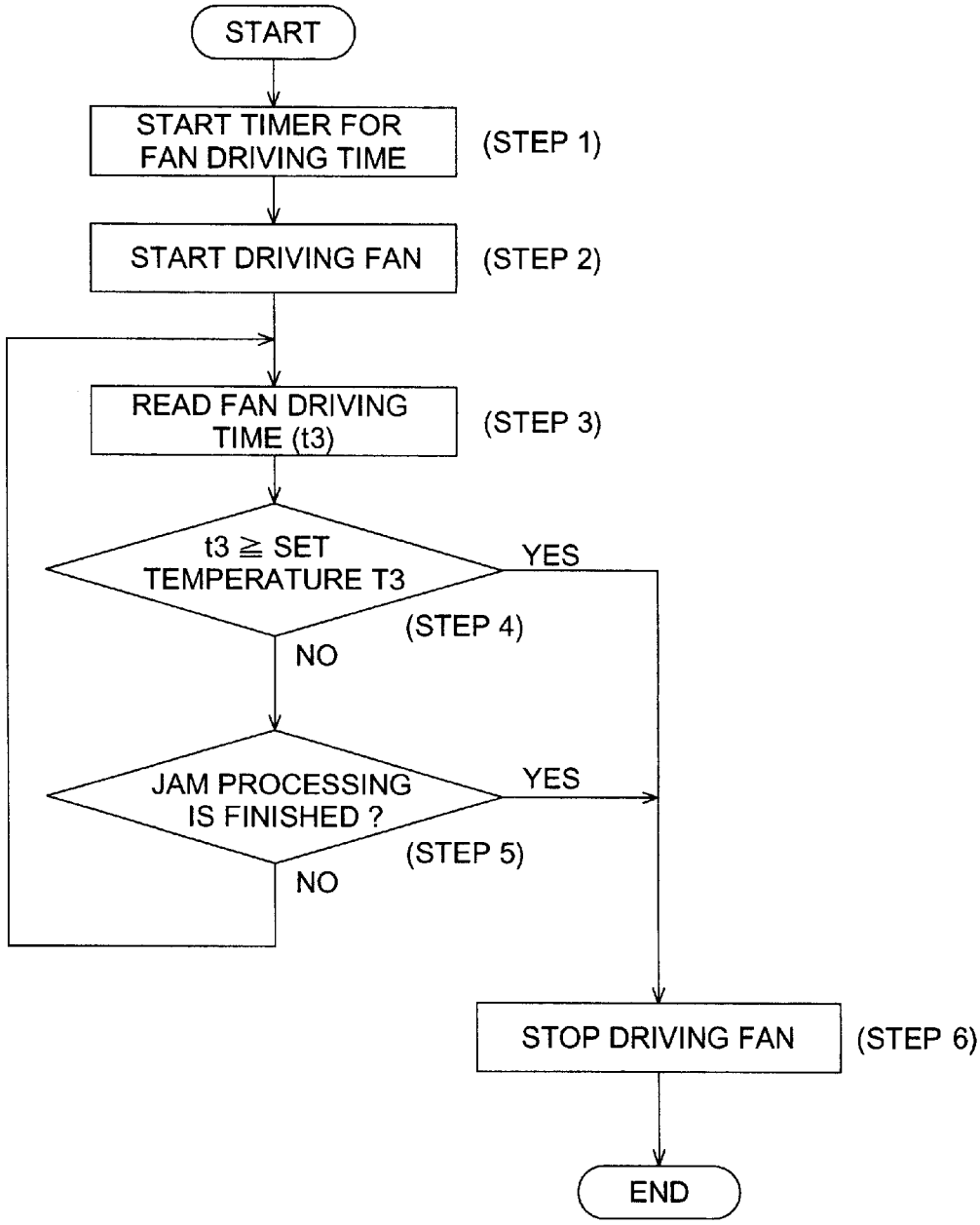
FIG. 14 shows a flowchart of another embodiment of the cooling-fan control-operation shown in FIG. 11.

Further, the flowchart shown in FIG. 14 is also applicable.

In FIG. 14, the control section 500 activates the timer 501 (step 1), and then, activates the fan 350 (step 2). At this time, the control section 500 moves the cooling area varying means 351 to such a position where the wind from the fan 350 is allowed to blow the all area of the heating roller 91, being apart from the fan 350.

Then, it reads the driving time (t3) of the fan 350 (step 1). When the driving time (t3) reaches to the predetermined time (T3) (step 2) or the jam processing is completed (step 5), control section 500 deactivates the fan 350 (step 6) to finish the jam control-operation and to continue the fixing control-operation.

(Copy-Finishing Control-Operation)

Figure 15:
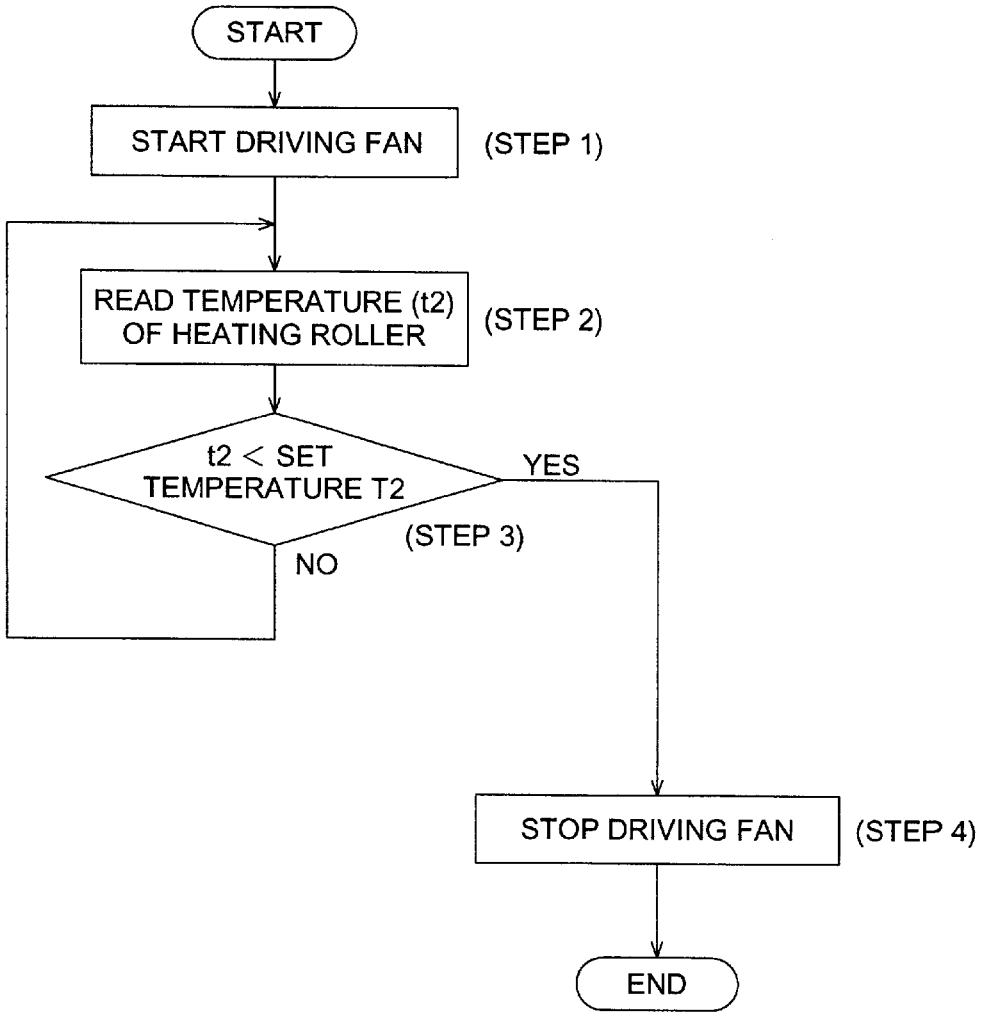
FIG. 15 shows a flowchart for explaining a copy-finishing control-operation.
Figure 16:
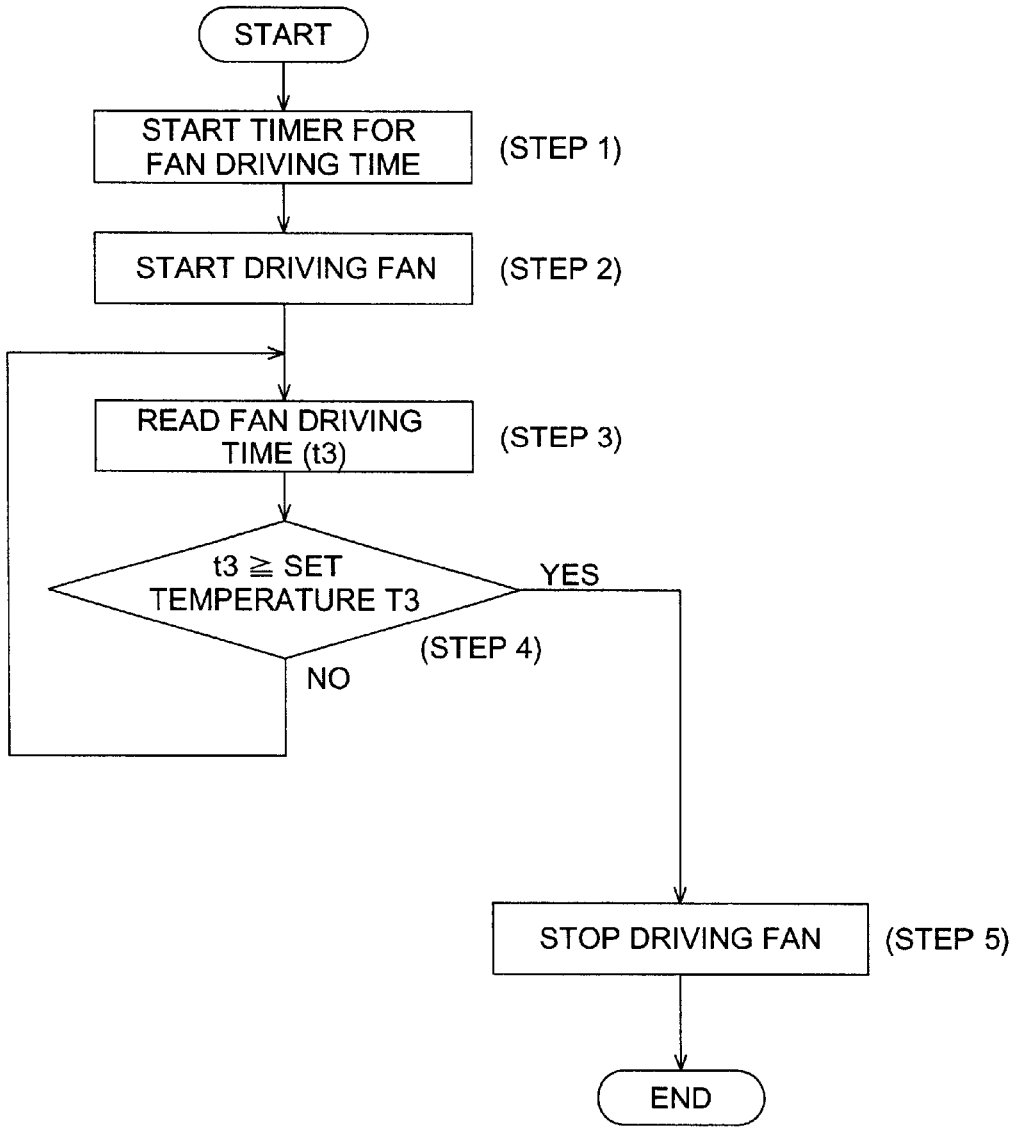
FIG. 16 shows a flowchart for explaining another embodiment of the copy-finishing control-operation.

Explanation will be given with reference to FIG. 15 and FIG. 16, which are the flow charts for explaining the copy-finishing control-operation of the fixing apparatus shown in FIG. 3. FIG. 15 shows a flowchart of the copy-finishing control-operation and FIG. 16 shows a flowchart of another embodiment of the copy-finishing control-operation.

In FIG. 15, when the copying-operation is completed, control section 500 activates fan 350 (step 1).

Next, the control section 500 receives the temperature information (t2) from the second temperature detecting means 340 (step 2), and makes a comparison between the temperature (t2) of the area L2 of the heating roller 91 and the predetermined temperature (T2) (step 3).

The fan 350 is activated until the temperature (t2) of the area L2 of the heating roller 91 decreases lower than the predetermined temperature (T2). When the temperature (t2) of the area L2 of the heating roller 91 decreases lower than the predetermined temperature (T2), control section 500 deactivates the fan 350 (step 4) to finish the copy-finishing control-operation, and conducts the idling control-operation.

Further, the flowchart shown in FIG. 16 is also applicable.

In FIG. 16, the control section 500 activates the timer 501 (step 1), and then, activates the fan 350 (step 2). At this time, it is possible for the control section 500 to move the cooling area varying means 351 to such a position where the wind from the fan 350 is allowed to blow the all area of the heating roller 91, being apart from the fan 350.

Then, it reads the driving time (t3) of the fan 350 (step 4). When the driving time (t3) reaches to the predetermined time (T3) (step 4), control section 500 deactivates the fan 350 (step 5) to finish the copy-finishing control-operation, and conducts the idling control-operation.

Figure 29:
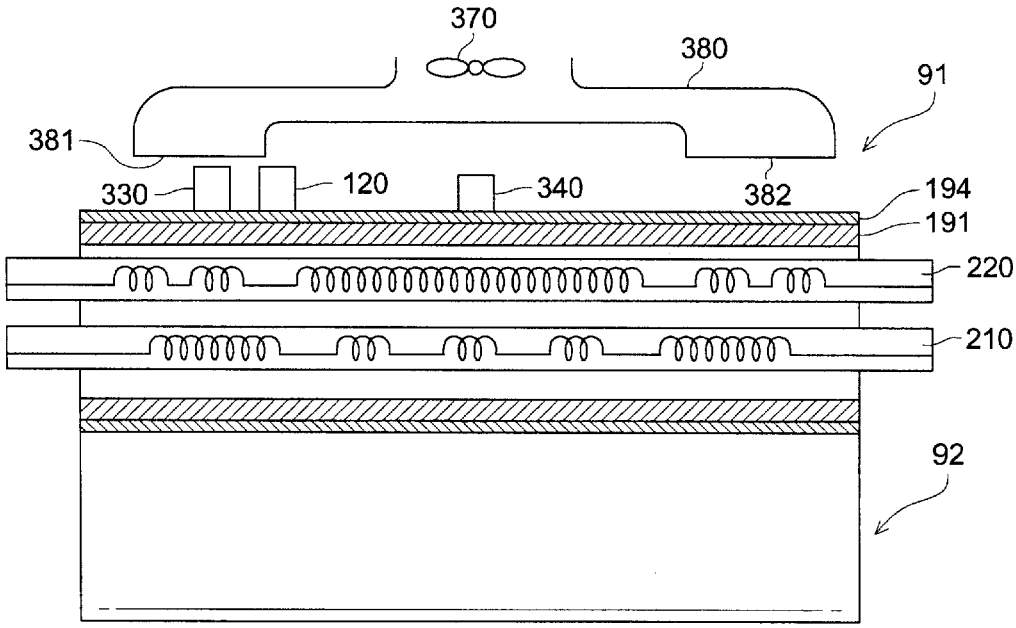
FIG. 29 shows a cross-sectional view of another example of the fixing apparatus as a variation of the present invention.

FIG. 29 shows a cross-sectional view of another example of the fixing apparatus as a variation of the embodiment 1. The same reference numbers denote the same elements in the fixing apparatus shown in FIG. 4. The configuration of the fan and the duct shown in FIG. 29 is different from that of the fixing apparatus shown in FIG. 4. Although five fans 350 are arrayed in the longitudinal direction of the heating roller 91 in the fixing apparatus shown in FIG. 4., only one fan 370, size of which is larger than that of the fan 350, is disposed at the center position in the longitudinal direction of the heating roller 91. Further, the wind generated by the fan 370 is guided along the duct 380 so as to blow onto the both ends of the heating roller 91 from the openings 381, 382. In the abovementioned embodiment, although the wind generated by the fan 370 directly blows onto only the both ends of the heating roller 91, the temperature of the central area of the heating roller 91 can also be reduced by lowering the temperature at the both ends. Specifically, when a relatively thin sleeve, for instance, having a thickness thinner than 2.0 mm, is employed for the base body member of the heating roller 91, even in the abovementioned embodiment, it is relatively easy to lower the temperature of the central area of the heating roller 91. According to the abovementioned embodiment, since only one set of a fan and its driving source is required, it is possible to reduce the space provided at the upper section of heating roller 91. Therefore, it becomes possible to contribute to the minimization of the fixing apparatus and/or the minimization of the image-forming apparatus. Incidentally, even in the abovementioned embodiment, when the fixing operation for the recording sheet P, having a predetermined size, is performed, it is possible to activate the fan 370 to prevent the temperature overshoot at the both ends by lowering the temperature of the heating roller 91 at an area outside the path of the recording sheet P.

In addition, as a further variation of the abovementioned embodiment, it is also possible to arrange a plurality of cooling rollers, which can both contact and separate from the heating roller 91, around a circumferential surface of the heating roller 91, instead of the fan.

[Second Embodiment]

The same reference numbers denote the same elements in the second embodiment as those in the first embodiment, and the duplicated explanations will be omitted.

(Fixing Apparatus)

Figure 17:
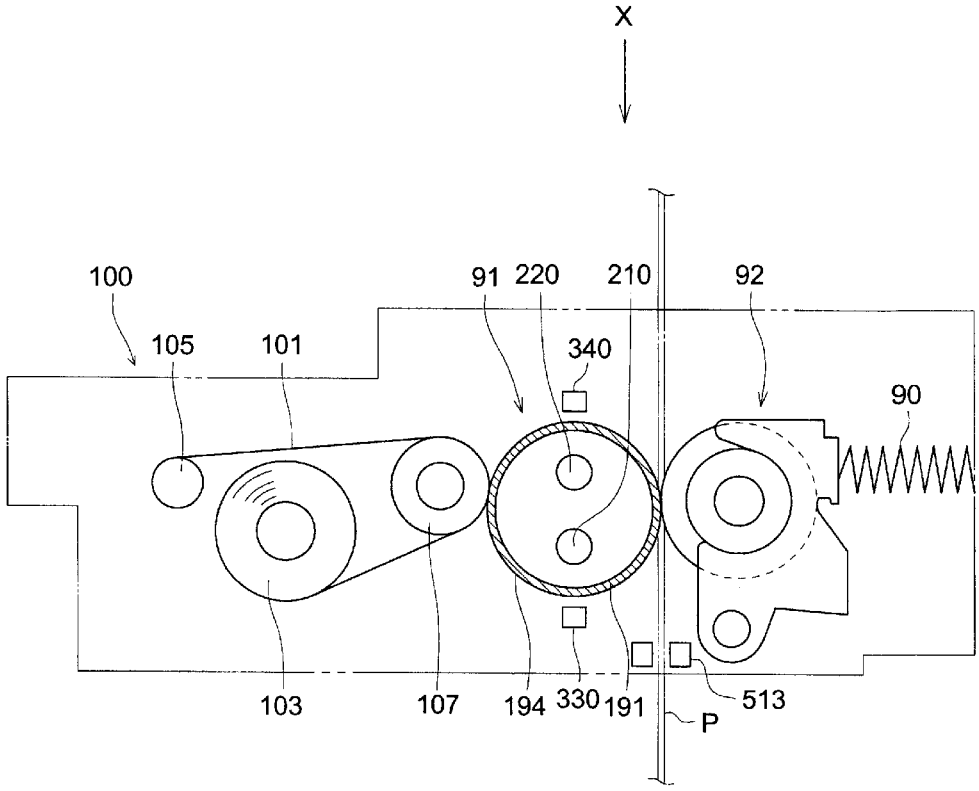
FIG. 17 shows a cross-sectional view of a fixing apparatus of the second embodiment of the present invention.
Figure 18:
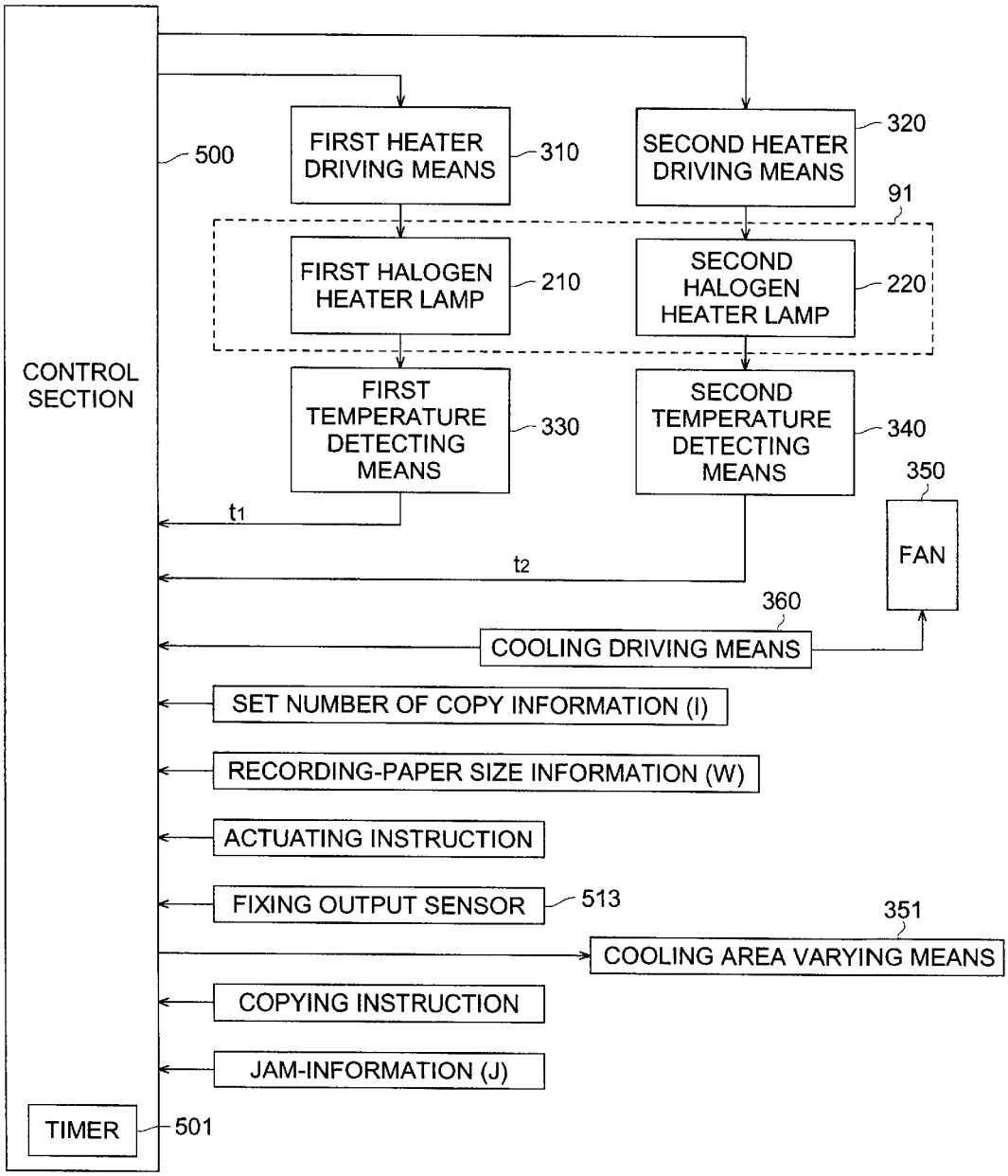
FIG. 18 shows a block diagram for explaining the electrical structure of the fixing apparatus of the second embodiment of the present invention.

Referring to FIG. 17 and FIG. 18, the fixing apparatus will be detailed in the following. As shown in FIG. 17, the fixing-output sensor 513, serving as a fixing-output detecting means for detecting a passage of the recording-paper P, is equipped at the outlet of the fixing apparatus.

Further, in FIG. 18 showing the electronic configuration of the fixing apparatus in the second embodiment, the control section 500 drives the first and second halogen heater lamps 210 and 220 through the first and second heater driving means 310 and 320, and also drives the fan 350 and the cooling area varying means 351 through the cooling driving means 360, by receiving the temperature information (t1) from the first temperature detecting means 330, the temperature information (t2) from the second temperature detecting means 340, the actuating instruction transmitted from the image forming apparatus mainframe when the power switch of the image forming apparatus mainframe is turned on, the information from the fixing-output sensor 513, the copying instruction transmitted from the image forming apparatus mainframe when the copy button of the image forming apparatus mainframe is turned on, the recording paper size information (W), the set copy number information (I) and the jam information (J) sent from the jam detecting means.

In the following, the operation of the fixing apparatus having the above-described structure will be explained with reference to FIG. 19–FIG. 23.

Figure 19:
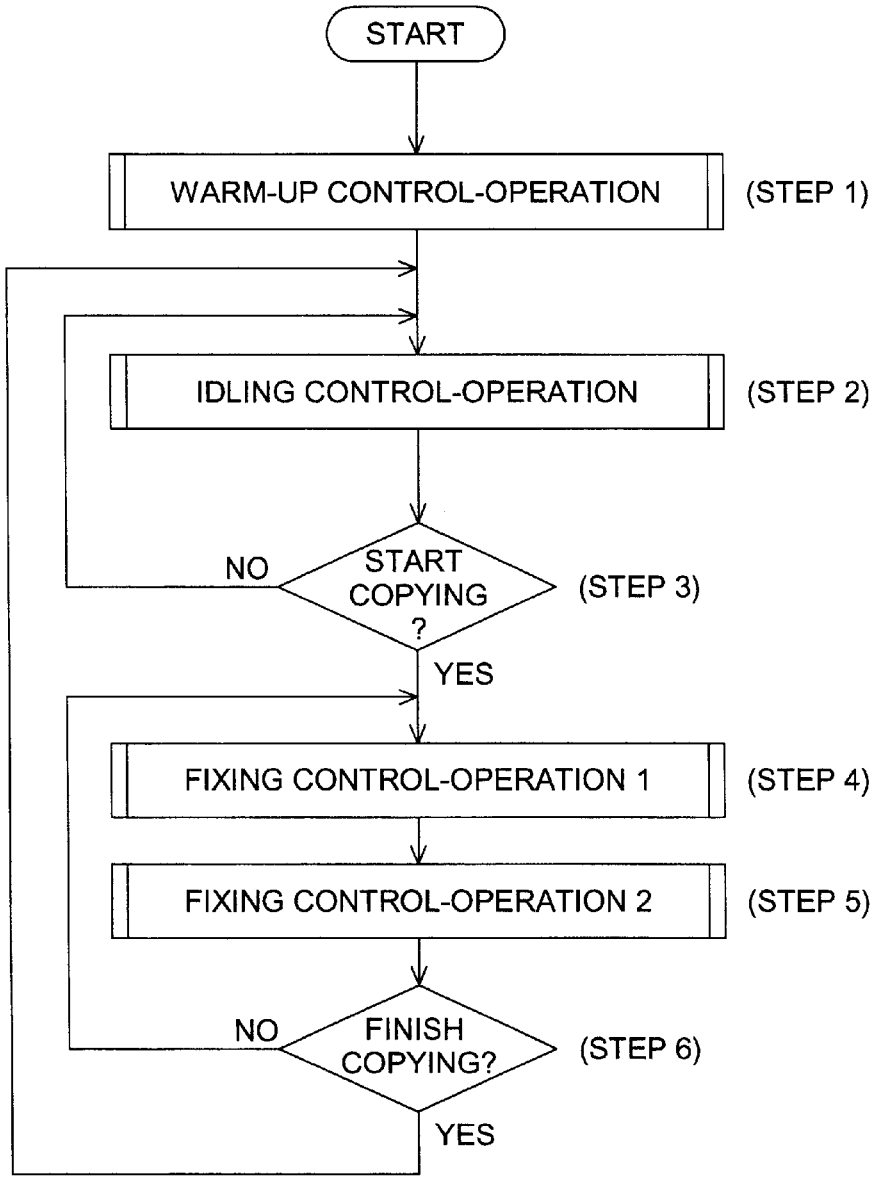
FIG. 19 shows a flowchart for explaining an overall operation of the control section shown in FIG. 18.

First, with reference to FIG. 19, which is a flowchart of the overall operation of the control section 500, the overall operation of the fixing apparatus will be explained.

When the power switch is turned on, the warm-up control-operation (step 1) is carried out, and when the warm-up is finished, the fixing apparatus enters into a standby state while performing idling control-operation (step 2), until the next copy command is received.

If a copying instruction is given during the idling control-operation (step 3), the fixing control-operation 1 (step 4) and the fixing control-operation 2 (step 5) are carried out.

If a copy-finishing instruction is given (step 6), it returns to the idling control-operation (step 2).

The explanations for the warm-up control-operation and the idling control-operation are omitted, since these are the same as those of the first embodiment.

(Fixing Control-Operation 1)

Figure 20:
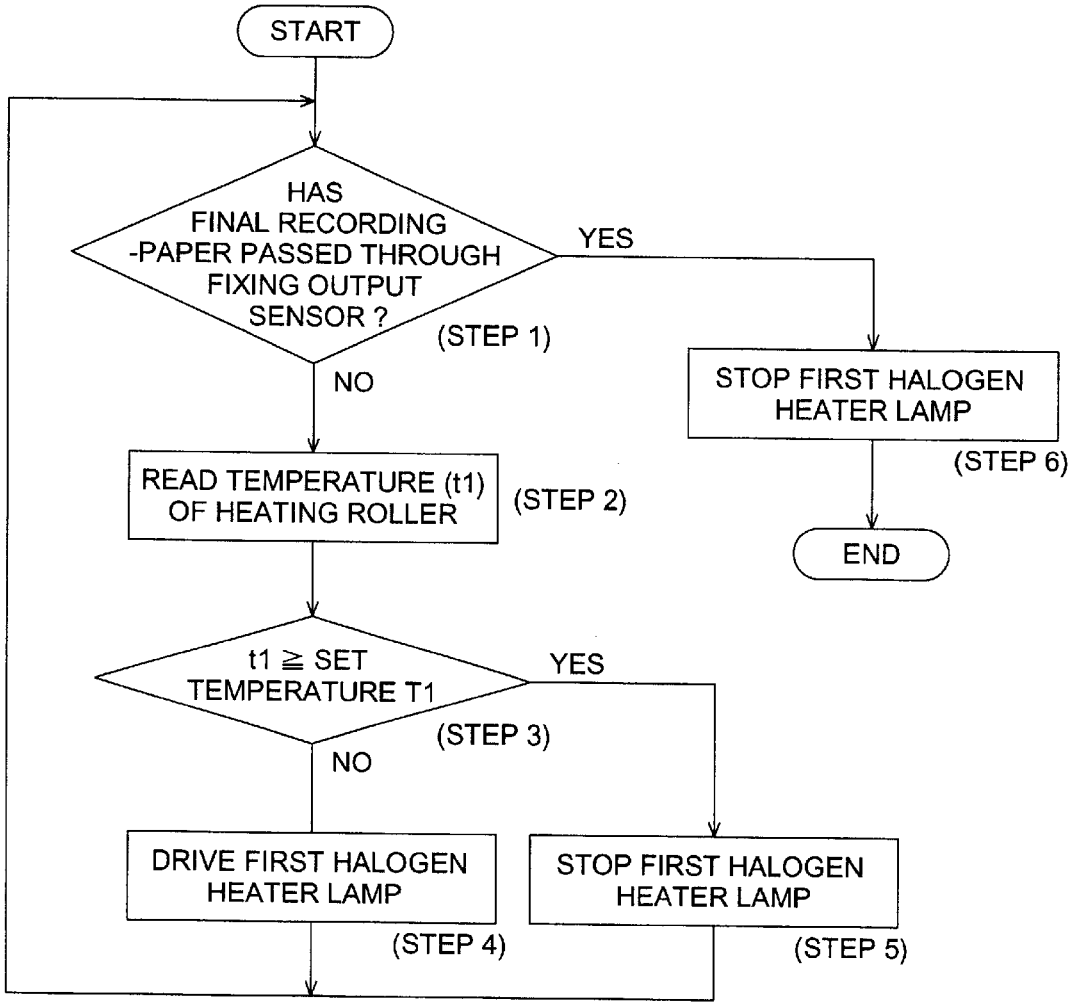
FIG. 20 shows a flowchart of fixing control-operation 1 shown in FIG. 19.

As shown in FIG. 20, the control section 500 receives the temperature information (t1) from the first temperature detecting means 330 (step 2), and makes a comparison between the temperature (t1) of the area L1 of the heating roller and the predetermined temperature (T1) (step 3), until the final recording-paper passes through the fixing-output sensor 513.

If the temperature (t1) of the heating roller 91 is lower than the predetermined temperature (T1), the first halogen heater lamp 210 is driven (step 4).

If the temperature (t1) of the heating roller 91 is equal to or higher than the predetermined temperature (T1), the driving of the first halogen heater lamp 210 is stopped (step 5).

Figure 21:
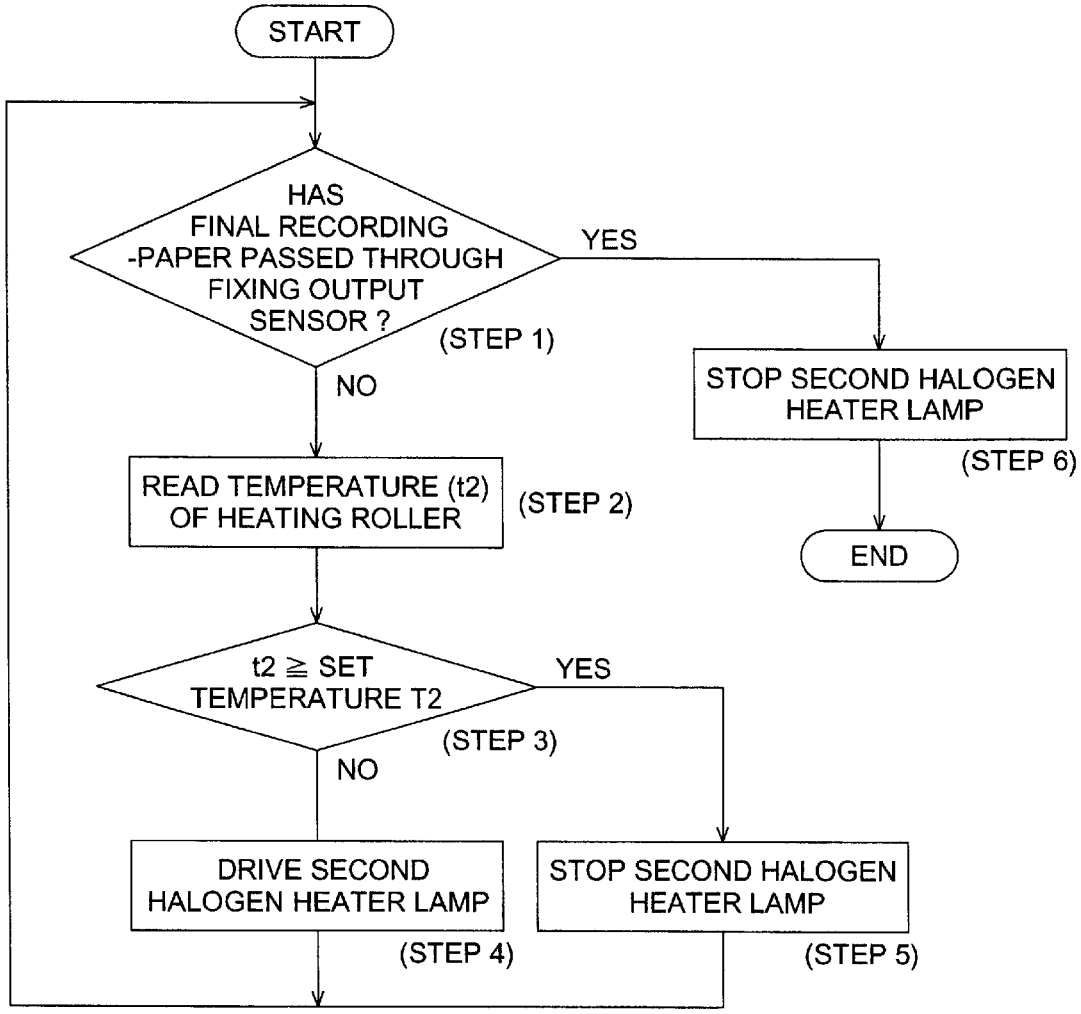
FIG. 21 shows a flowchart of fixing control-operation 1 shown in FIG. 19.

In the same manner, as shown in FIG. 21, the control section receives the temperature information (t2) from the second temperature detecting means 340 (step 2), and makes a comparison between the temperature (t2) of the area L2 of the heating roller 91 and the predetermined temperature (T2) (step 3), until the final recording-paper passes through the fixing-output sensor 513.

If the temperature (t2) of the heating roller 91 is lower than the predetermined temperature (T2), the second halogen heater lamp 220 is driven (step 4).

If the temperature (t2) of the heating roller 91 is equal to or higher than the predetermined temperature (T2), the driving of the second halogen heater lamp 220 is stopped (step 5).

On the other hand, when the final recording-paper passes through the fixing-output sensor 513 in step 1 of FIG. 20 and FIG. 21, control section 500 deactivates the first and second halogen heater lamps 210, 220, and enters into the fixing control-operation 2.

(Fixing Control-Operation 2)

Figure 22:
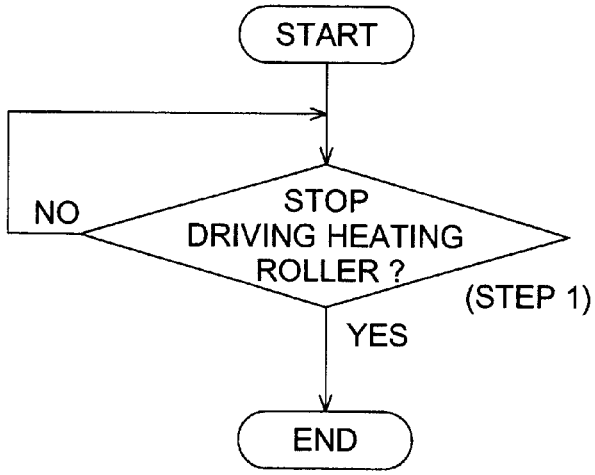
FIG. 22 shows a flowchart of fixing control-operation 2 shown in FIG. 19.

As shown in FIG. 22, the driving operation for the first and second halogen heater lamps 210, 220 continues, until a drive-stopping instruction for the heating roller 91 is outputted (step 1).

Figure 23:
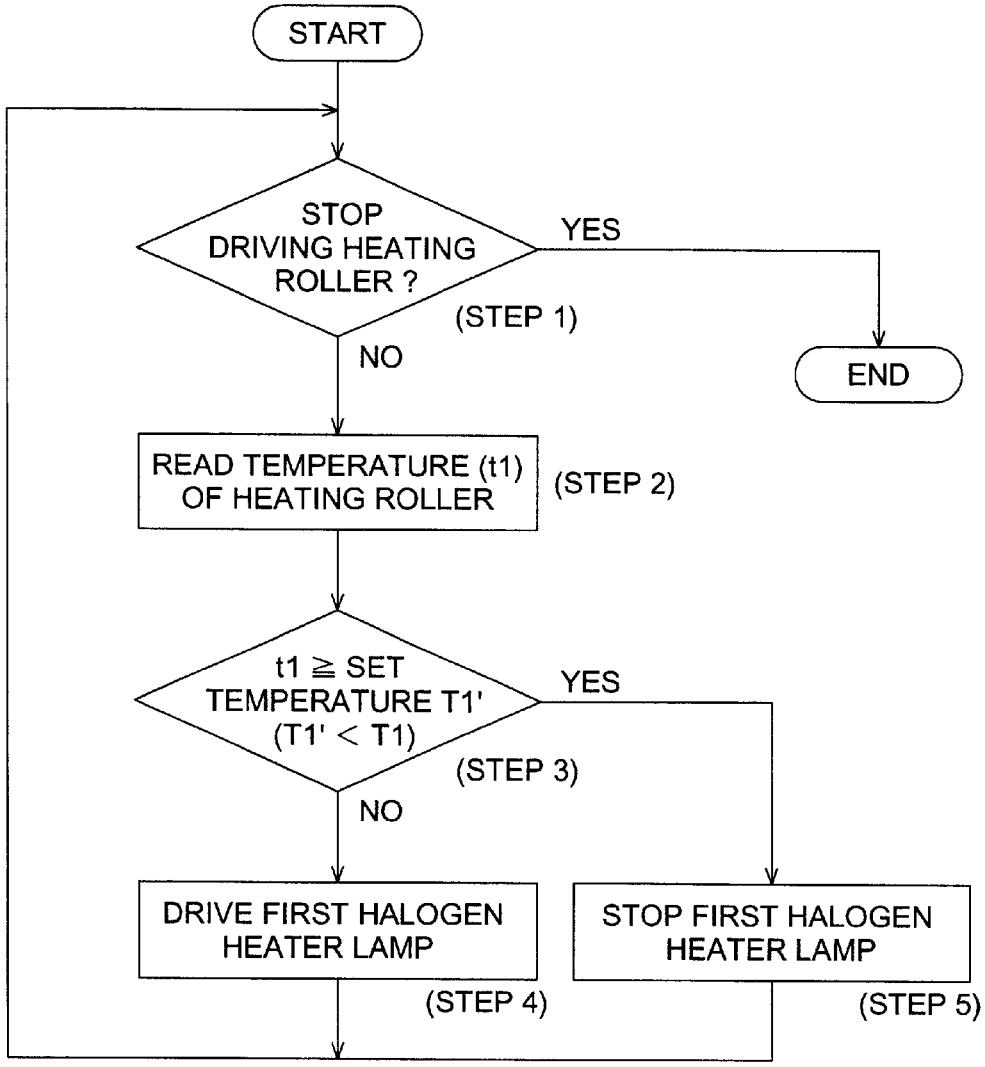
FIG. 23 shows a flowchart of another embodiment of fixing control-operation 2 shown in FIG. 19.
Figure 24:
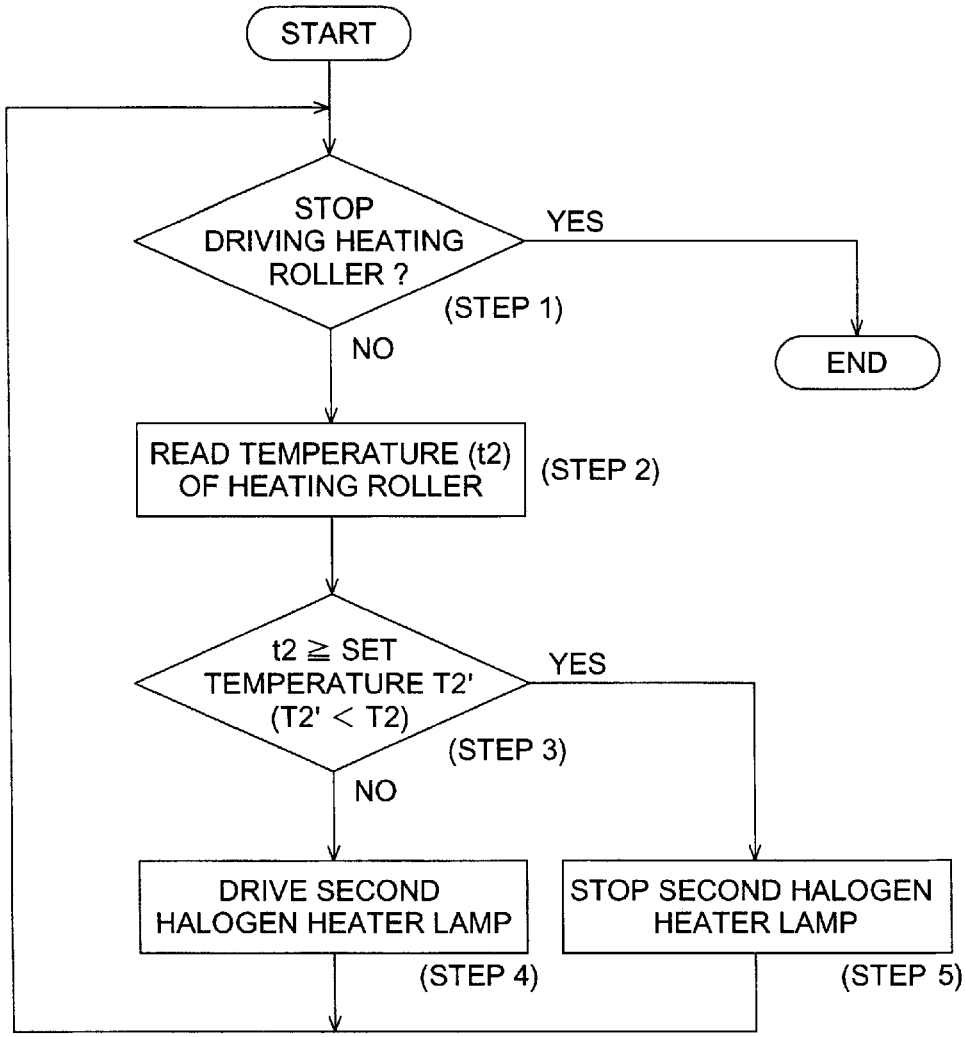
FIG. 24 shows a flowchart of another embodiment of fixing control-operation 2 shown in FIG. 19.

Further, the flowcharts shown in FIG. 23 and FIG. 24 are also applicable.

As shown in FIG. 23 and FIG. 24, the following operations are conducted, until a drive-stopping instruction for the heating roller 91 is outputted (step 1).

As shown in FIG. 23, the control section receives the temperature information (t1) from the first temperature detecting means 330 (step 2), and makes a comparison between the temperature (t1) of the area L1 of the heating roller 91 and the predetermined temperature (T1':T1'<T1) (step 3).

If the temperature (t1) of the heating roller 91 is lower than the predetermined temperature (T1'), the first halogen heater lamp 210 is driven (step 4). If the temperature (t1) of the heating roller 91 is equal to or higher than the predetermined temperature (T1'), the driving of the first halogen heater lamp 210 is stopped (step 5), and the control section 500 returns to step 1.

In the same manner, as shown in FIG. 24, the control section receives the temperature information (t2) from the second temperature detecting means 340 (step 2), and makes a comparison between the temperature (t2) of the area L2 of the heating roller 91 and the predetermined temperature (T2':T2'<T2) (step 3).

If the temperature (t2) of the heating roller 91 is lower than the predetermined temperature (T2'), the second halogen heater lamp 220 is driven (step 4). If the temperature (t2) of the heating roller 91 is equal to or higher than the predetermined temperature (T2'), the driving of the second halogen heater lamp 220 is stopped (step 5), and the control section 500 returns to step 1.

Namely, the temperature is controlled so as to decrease lower than that during the fixing operation.

Figure 25:
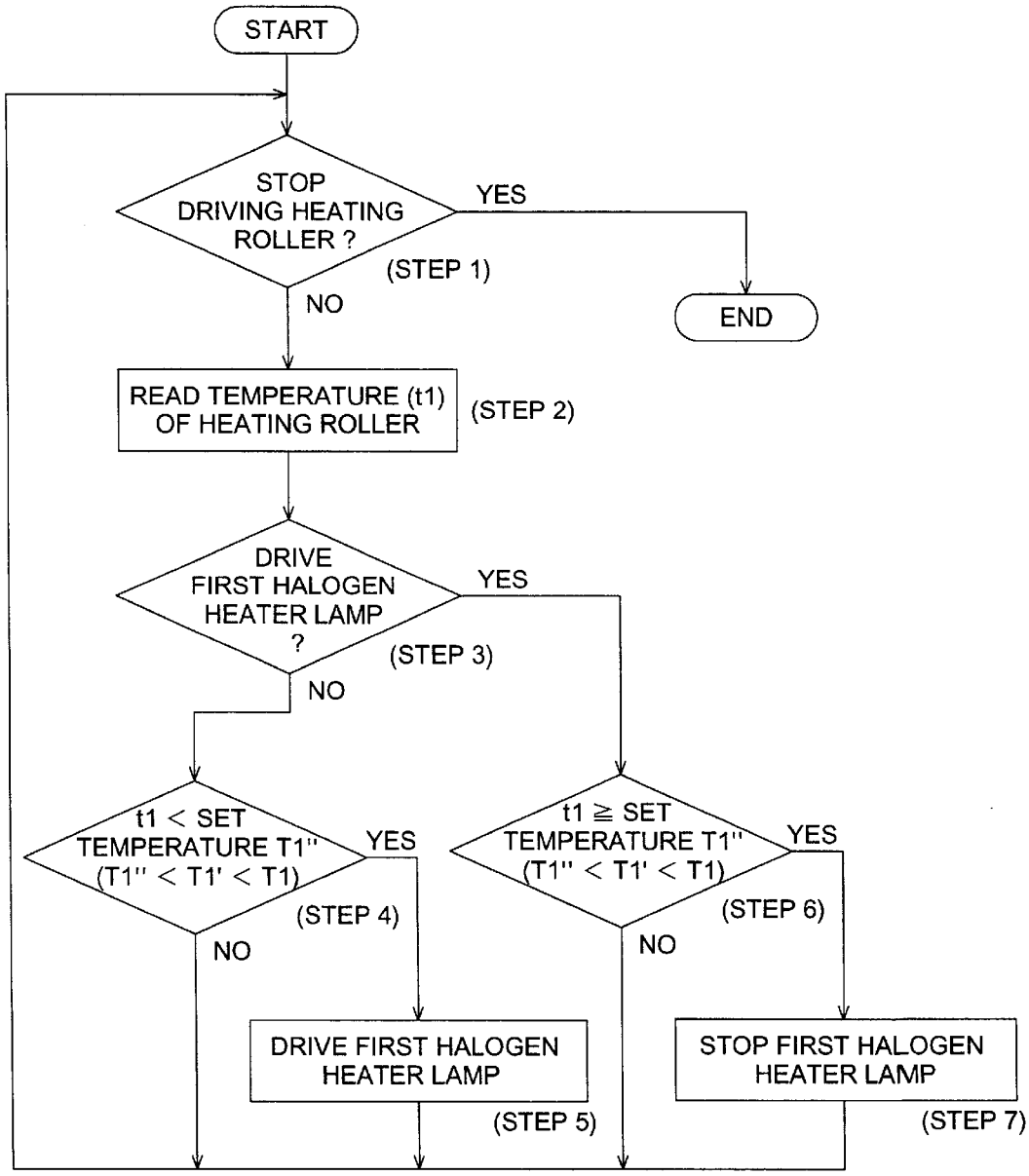
FIG. 25 shows a flowchart of another embodiment of fixing control-operation 2 shown in FIG. 19.
Figure 26:
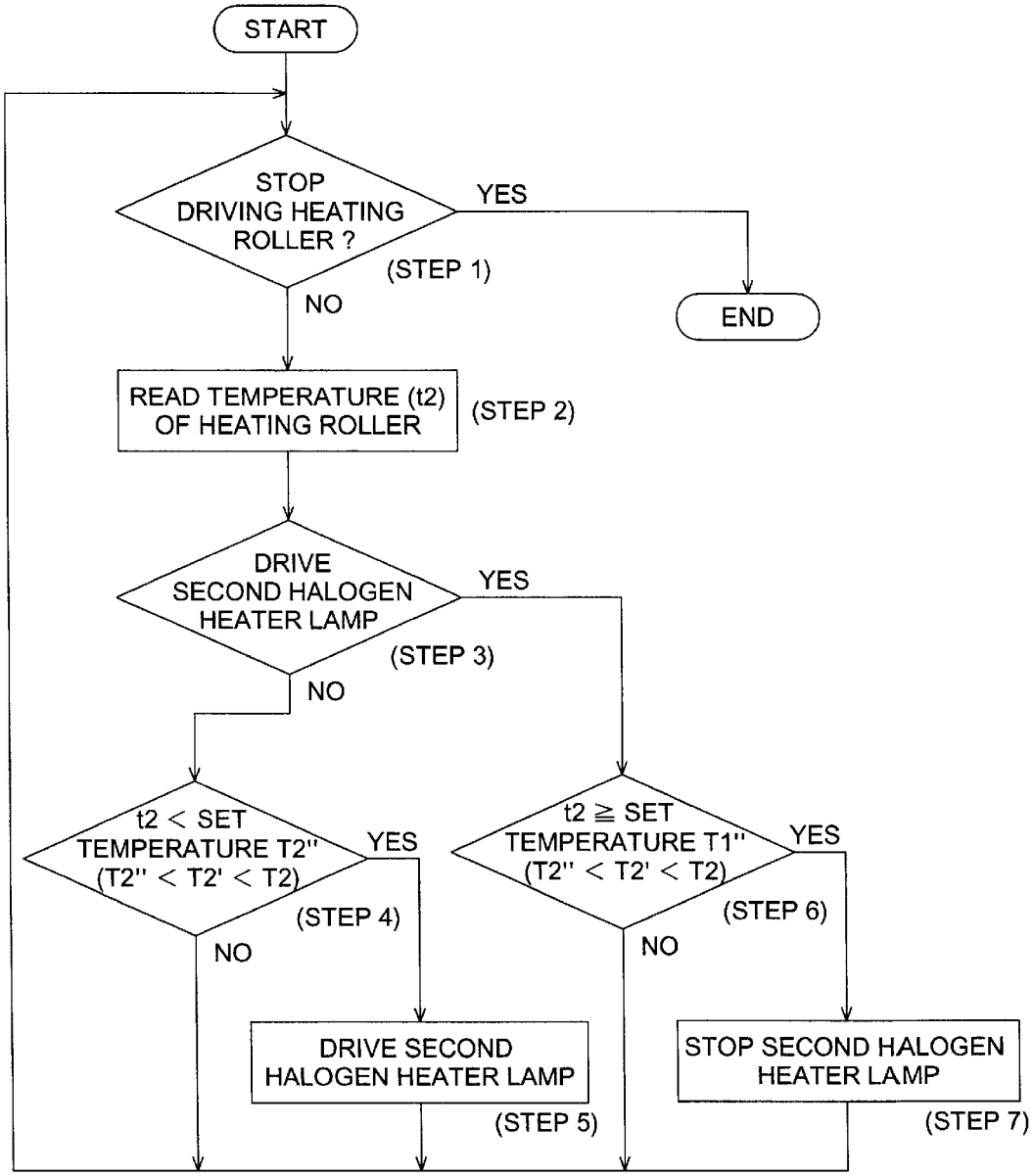
FIG. 26 shows a flowchart of another embodiment of fixing control-operation 2 shown in FIG. 19.
Figure 27:
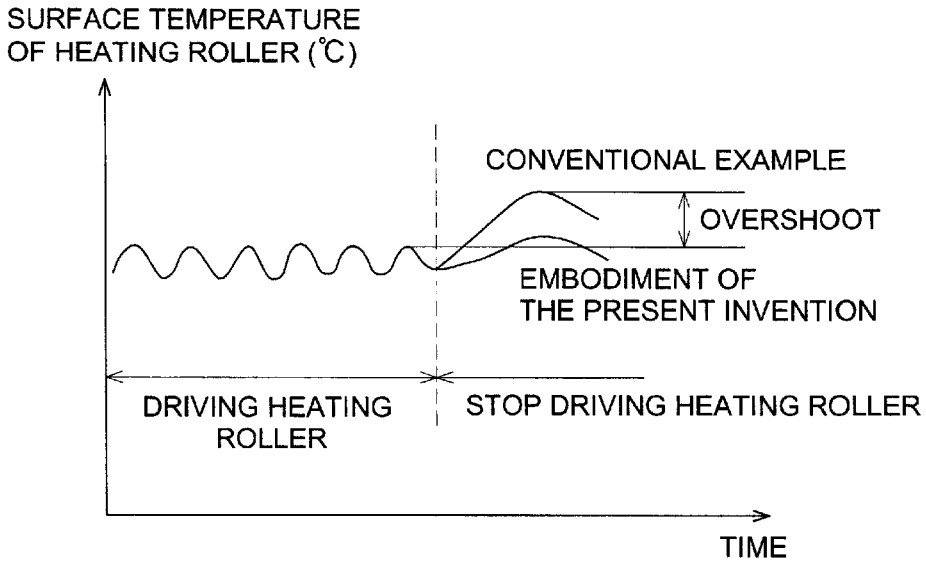
FIG. 27 shows a graph for explaining a problem in conventional fixing apparatus and for illustrating a difference between a conventional fixing apparatus and a fixing apparatus embodied in the present invention.
Figure 28:
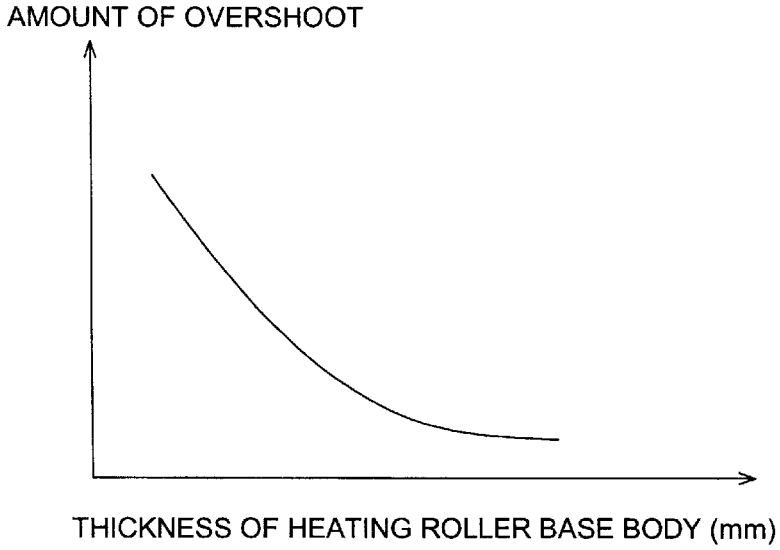
FIG. 28 shows a graph for explaining a problem in conventional fixing apparatus.

Further, the flowcharts shown in FIG. 25 and FIG. 26 are also applicable.

As shown in FIG. 25 and FIG. 26, the following operations are conducted, until a drive-stopping instruction for the heating roller 91 is outputted (step 1).

As shown in FIG. 25, the control section 500 receives the temperature information (t1) from the first temperature detecting means 330 (step 2), and determines whether or not the first halogen heater lamp 210 is activated (step 3). When not in step 3, if the temperature information (t1) is not lower than the predetermined temperature (T1":T1"<T1'<T1), the control section 500 continues to deactivate the first halogen heater lamp 210, or if the temperature information (t1) is lower than the predetermined temperature (T1"), the control section 500 activates the first halogen heater lamp 210 (step 4, step 5).

On the other hand, when the first halogen heater lamp 210 is activated in step 3, if the temperature information (t1) is lower than the predetermined temperature (T1':T1"<T1'<T1), the control section 500 continues to activate the first halogen heater lamp 210, or if the temperature information (t1) is not lower than the predetermined temperature (T1'), the control section 500 deactivates the first halogen heater lamp 210 (step 6, step 7).

In the same manner, as shown in FIG. 26, the control section 500 receives the temperature information (t2) from the second temperature detecting means 340 (step 2), and determines whether or not the second halogen heater lamp 220 is activated (step 3). When not in step 3, if the temperature information (t2) is not lower than the predetermined temperature (T2":T2"<T2'<T2), the control section 500 continues to deactivate the second halogen heater lamp 220, or if the temperature information (t2) is lower than the predetermined temperature (T2"), the control section 500 activates the second halogen heater lamp 220 (step 4, step 5).

On the other hand, when the second halogen heater lamp 220 is activated in step 3, if the temperature information (t2) is lower than the predetermined temperature (T2':T2"<T2'<T2), the control section 500 continues to activate the second halogen heater lamp 220, or if the temperature information (t2) is not lower than the predetermined temperature (T2'), the control section 500 deactivates the second halogen heater lamp 220 (step 6, step 7).

In other words, when the detected results of the first and second temperature detecting means 330, 340 decreases lower than the predetermined temperature (T1", T2"), the control section 500 activates the first and second halogen heater lamps 210, 220, while, when the detected results of the first and second temperature detecting means 330, 340 increases higher than the predetermined temperature (T1', T2'), the control section 500 deactivates the first and second halogen heater lamps 210, 220. Namely, the control section 500 controls the operations for driving the first and second halogen heater lamps 210, 220 in a hysteresis-controlling mode (an on-off controlling mode) having operating intervals.

According to the abovementioned configuration, the following effects can be obtained.

(1) Since the control section 500 continues to activate the fan 350 during a predetermined time period after the fixing operation is completed, the temperature overshoot of the heating roller 91 can be suppressed when the heating roller 91 stops.

(2) Since the control section 500 continues to activate the fan 350 until the temperature of the heating roller 91 reaches to a predetermined temperature after the fixing operation is completed by receiving the temperature information from temperature detecting means 340, the temperature overshoot of the heating roller 91 can be suppressed when the heating roller 91 stops.

(3) Since the control section 500 receives the jam-information and deactivates the first and second halogen heater lamps 210, 220 at the time of the jam-occurrence and continues to activate the fan 350 until the jam processing is completed, the temperature overshoot of the heating roller 91 can be suppressed when the heating roller 91 stops.

(4) Since the control section 500 receives the jam-information and deactivates the first and second halogen heater lamps 210, 220 at the time of the jam-occurrence and continues to activate the fan 350 either until the temperature of the heating roller 91 reaches to the predetermined temperature or until the jam processing is completed, the temperature overshoot of the heating roller 91 can be suppressed when the heating roller 91 stops.

(5) Since the control section 500 receives the jam-information and deactivates the first and second halogen heater lamps 210, 220 at the time of the jam-occurrence and continues to activate the fan 350 either during the predetermined time period or until the jam processing is completed, the temperature overshoot of the heating roller 91 can be suppressed when the heating roller 91 stops.

(6) Since the cooling region of the heating roller 91 can be varied in the longitudinal direction of the heating roller 91 by means of the cooling area varying means 351, it becomes possible to cool all over the heating roller 91 to suppress its temperature overshoot when the heating roller 91 stops.

Further, when the fixing operation repeatedly conducted for fixing a large number of recording-papers having a narrow width, it is also possible to cool only the end portion of the heating roller 91 to prevent the end portion of the heating roller 91 from over heating.

(7) Since the control section 500 receives the information from the fixing-output sensor 513 and deactivates the first and second halogen heater lamps 210, 220 when the final recording-paper has passed, namely, before outputting the instruction for stopping the heating roller 91, and sets the threshold value of the fixing control temperature at a value lower than the temperature during the fixing operation, the temperature overshoot of the heating roller 91 can be suppressed when the heating roller 91 stops.

(8) Since the control section 500 receives the information from the fixing-output sensor 513 and deactivates the first and second halogen heater lamps 210, 220 when the final recording-paper has passed, namely, during the period from the time before the heating roller 91 stops to the time when the heating roller 91 stops, the temperature overshoot of the heating roller 91 can be suppressed when the heating roller 91 stops.

According to the present invention, the following effects can be obtained.

(1) Since the control section continues to activate the cooling means during a predetermined time period after the fixing operation is completed, the temperature overshoot of the heating roller can be suppressed when the heating roller stops.

(2) Since the control section continues to activate the cooling means until the temperature of the heating roller reaches to a predetermined temperature after the fixing operation is completed by receiving the temperature information from the temperature detecting means, the temperature overshoot of the heating roller can be suppressed when the heating roller stops.

(3) Since the control section receives the jam-information and deactivates the heating means of the heating roller at the time of the jam-occurrence and continues to activate the cooling means until the jam processing is completed, the temperature overshoot of the heating roller can be suppressed when the heating roller stops.

(4) Since the control section receives the jam-information and deactivates the heating means of the heating roller at the time of the jam-occurrence and continues to activate the cooling means either until the temperature of the heating roller reaches to the predetermined temperature or until the jam processing is completed, the temperature overshoot of the heating roller can be suppressed when the heating roller stops.

(5) Since the control section receives the jam-information and deactivates the heating means of the heating roller at the time of the jam-occurrence and continues to activate the cooling means either during the predetermined time period or until the jam processing is completed, the temperature overshoot of the heating roller can be suppressed when the heating roller stops.

(6) Since the cooling region of the heating roller can be varied in the longitudinal direction of the heating roller by means of the cooling area varying means, it becomes possible to cool all over the heating roller to suppress its temperature overshoot when the heating roller stops.

Further, when the fixing operation repeatedly conducted for fixing a large number of recording-papers having a narrow width, it is also possible to cool only the end portion of the heating roller to prevent the end portion of the heating roller from over heating.

(7) Since the control section receives the information from the fixing-output detecting means and deactivates the heating means of the heating roller when the final recording-paper has passed, namely, before outputting the instruction for stopping the heating roller, and sets the threshold value of the fixing control temperature at a value lower than the temperature during the fixing operation, the temperature overshoot of the heating roller can be suppressed when the heating roller stops.

(8) Since the control section receives the information from the fixing-output detecting mean and deactivates the heating means of the heating roller when the final recording-paper has passed, namely, during the period from the time before the heating roller stops to the time when the heating roller stops, the temperature overshoot of the heating roller can be suppressed when the heating roller stops.

Disclosed embodiment can be varied by a skilled person without departing from the spirit and scope of the invention.

What is claimed is:

1. A fixing apparatus, comprising:

a heating roller;

a heating element disposed in said heating roller;

a pressing roller pressure-contacting said heating roller to fix an image onto a transfer sheet passing through a pressure-contacting section between said heating roller and said pressing roller; and a cooling device to cool said heating roller;

wherein, in case of a jam occurence, said heating element is deactivated and said cooling device is activated until a jam-processing is completed.

2. The fixing apparatus of claim 1, further comprising:

a temperature detecting device to detect a temperature of said heating roller;

wherein said cooling device is deactivated either when said jam processing is completed or when said temperature of said heating roller is lowered to a predetermined temperature based on a result detected by said temperature detecting device.

3. The fixing apparatus of claim 1, wherein said cooling device is deactivated either when said jam processing is completed or when a determined time period has elapsed.

4. The fixing apparatus of claim 1, wherein a cooling region cooled by said cooling device is variable in a longitudinal direction of said heating roller.

5. An image-forming apparatus, comprising:

a heating roller;

a heating element disposed in said heating roller;

a pressing roller pressure-contacting said heating roller to fix an image onto a transfer sheet passing through a pressure-contacting section between said heating roller and said pressing roller;

a cooling device to cool said heating roller;

a jam-detecting device to detect a jam occurrence; and a control section to deactivate said heating element and to activate said cooling device when said jam-detecting device detects said jam occurrence, until a jam-processing is completed.

6. The image-forming apparatus of claim 5, further comprising:

a door member to be opened and closed when said jam-processing is performed; and a door status detecting device to detect an opened or closed status of said door member;

wherein said control section deactivates said cooling device and activates again said heating element when said jam-detecting device detects a completion of said jam-processing and said door status detecting device detects said closed status of said door member.

7. The image-forming apparatus of claim 5, further comprising:

a temperature detecting device to detect a temperature of said heating roller;

wherein said control section deactivates said cooling device either when said jam-processing is completed or when said temperature of said heating roller is lowered to a predetermined temperature based on a result detected by said temperature detecting device.

8. The image-forming apparatus of claim 5, wherein said control section deactivates said cooling device either when said jam-processing is completed or when a predetermined time period has elapsed.

9. The image-forming apparatus of claim 5, wherein a cooling region cooled by said cooling device is variable.

10. The image-forming apparatus of claim 9, wherein said cooling device comprises a plurality of fans arrayed in a longitudinal direction of said heating roller, and said image-forming apparatus further comprising:

a cooling region varying device to shade said heating roller from wind blown by at least a fan included in the plurality of fans, in order to vary a cooling region cooled by said cooling device.

* * * * *